United States Patent [19]

Gerben

[11] 4,042,148

[45] Aug. 16, 1977

[54] CUP FILLING AND CAPPING APPARATUS

[75] Inventor: Ralph D. Gerben, Glen Burnie, Md.

[73] Assignee: Solo Cup Company, Urbana, Ill.

[21] Appl. No.: 667,649

[22] Filed: Mar. 17, 1976

Related U.S. Application Data

[62] Division of Ser. No. 470,379, May 16, 1974, Pat. No. 3,965,656.

[51] Int. Cl.[2] ..... B65G 59/10; B65G 59/06; B65G 33/06; B65G 33/38

[52] U.S. Cl. ..... 221/222; 221/236

[58] Field of Search ..... 221/221, 222, 236

[56] References Cited

U.S. PATENT DOCUMENTS

| | | | |
|---|---|---|---|
| 1,824,660 | 9/1931 | Darner | 221/222 X |
| 2,948,434 | 8/1960 | Wolter | 221/236 X |
| 3,098,585 | 7/1963 | Giepen | 221/222 X |
| 3,426,941 | 2/1969 | Hovekamp | 221/222 |
| 3,756,452 | 9/1973 | Buhayar et al. | 221/236 X |
| 3,840,150 | 10/1974 | Kinney | 221/222 |
| 3,890,767 | 6/1975 | Cawrse | 53/296 |

*Primary Examiner*—Othell M. Simpson
*Assistant Examiner*—Horace M. Culver
*Attorney, Agent, or Firm*—Fitch, Even, Tabin & Luedeka

[57] ABSTRACT

An apparatus is disclosed for automatically dispensing cups to a continuously moving flight conveyor having openings for receiving the cups and carrying the same continuously forward through a cup-filling station, a cup capping station and a cup discharge station. A cup filling means travels forwardly while filling the cups and a heat sealer means heat seals cups to the cup rims while traveling forwardly with the cups. At the discharge station, the cups are automatically lifted and transferred from openings in the flight conveyor to a take-off means as the cups continuously travel forwardly. The apparatus is also capable of being modified to operate on an intermittent feed basis with the cups stopping at each of the respective stations.

4 Claims, 41 Drawing Figures

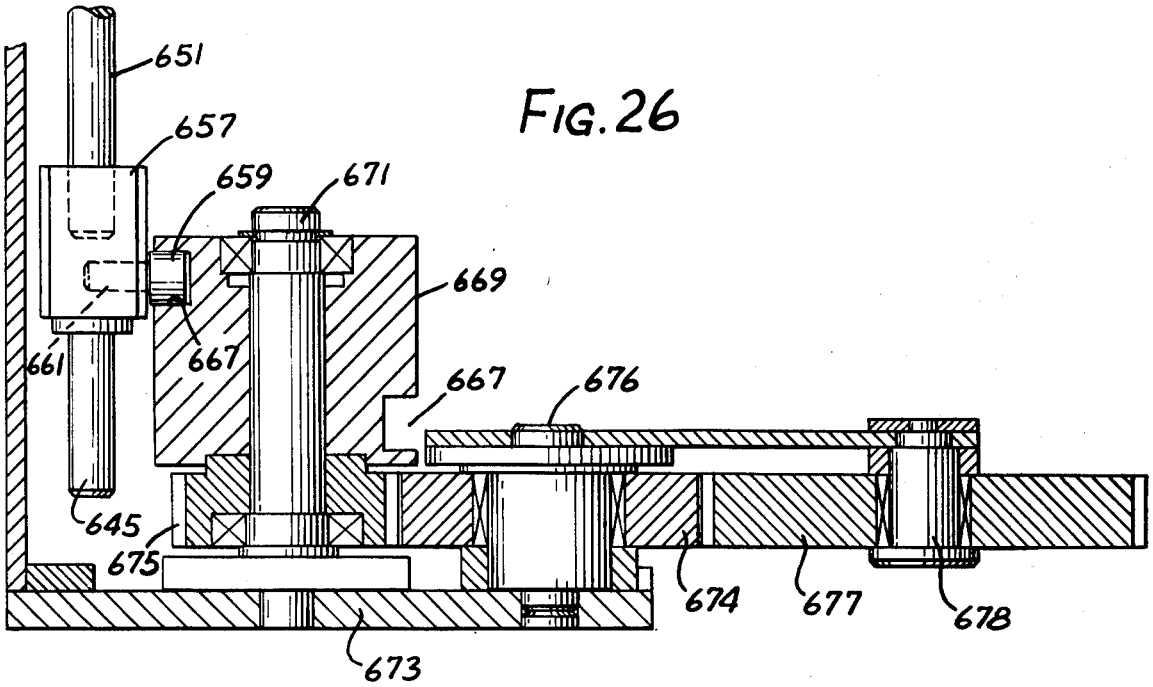
FIG. 26
FIG. 27
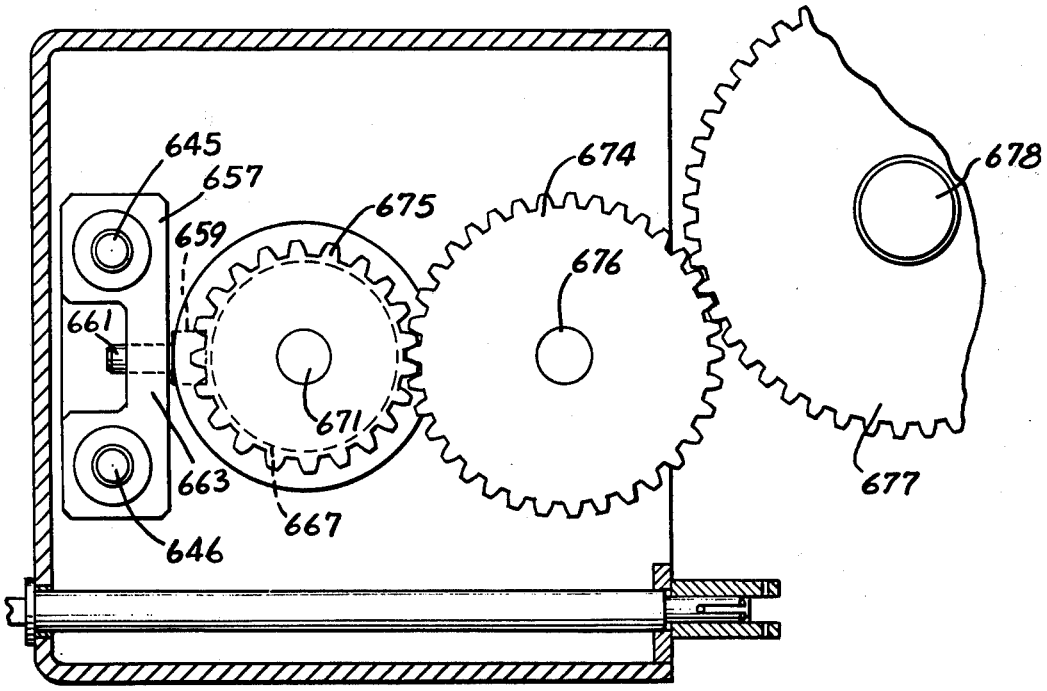

CUP FILLING AND CAPPING APPARATUS

This is a division, of application Ser. No. 470,379 filed May 16, 1974 and now U.S. Pat. No. 3,965,656.

This invention relates to a cup filling and capping apparatus having a flight conveyor for receiving and carrying plural rows of cups through filling and capping stations to discharge filled and closed cups at a discharge end of the flight conveyor.

Apparatus of this kind automatically receives, fills and caps thin walled plastic cups or containers with comestibles usually in liquid or semi-liquid form, for example, orange juice, tomato juice, milk, ice cream, soft drinks, gelatin type desserts and other types of food. Such cups are generally provided with truncated conical walls with an enlarged upper open end having a thickened or rolled rim to which the cap is affixed and sealed to prevent spilling and contamination of the contents of the comestibles. Because cups are very lightweight and thin walled, various problems have been encountered with high speed depositing the cups in openings on the flight conveyor, filling the cups, transporting the cups and capping the cups without spilling.

Generally, apparatus for filling thin walled plastic containers of this kind has been intermittent in operation in that the flight conveyor stops at one or more of the cup receiving, filling, capping or cup discharging stations. Starting and stopping of the cups during their travel is generally undesirable for several reasons. First, it curtails the rate of travel and production of the apparatus and also may cause spillage of the liquid contents in cups due to the inertia of the liquid resisting acceleration and deceleration if the cups are started brought to a relatively high speed in the interval between stations and then stopped at the next downstream station.

Many users of apparatus of this kind, market several sizes of filled cups and desire to switch quickly between the various cup sizes without a long down time or a considerable modification of the apparatus. Thus, it is preferred that the apparatus be readily adaptable to accommodate several sizes of cups and to dispense various quantities of the comestibles depending upon the size of the container used. Likewise, it is necessary that the metering apparatus be capable of adjustment to provide a measured portion for the size of cup being filled. Additionally, the flight conveyor and other apparatus must be adapted for holding, carrying and discharging these various sizes of containers as well as cpping these various sizes of containers.

For some comestibles, it is important the cup filling and capping apparatus be installed at or adjacent existing comestible making apparatus and within confined spaces. Therefore, it is preferred that the apparatus be a self-contained relatively small unit which can be readily transported to and positioned adjacent any one of several sources of comestibles being packaged. Of course, to be economically attractive, the apparatus should be simple to operate and commercially competitive from a cost standpoint.

Accordingly, an object of the present invention is to provide an improved apparatus of the foregoing kind in which the thin walled plastic cups are continuously traveled through the various container receiving, filling, capping and discharge stations.

Other objects and advantages of the invention will become apparent from the following detailed description taken in connection with the accompanying drawings in which:

FIG. 26 is a sectional view of a cam mechanism for shifting the elevator mechanism longitudinally in the direction of cup travel;

FIG. 27 is an elevational view of a mechanism of FIG. 26;

Figure 1:
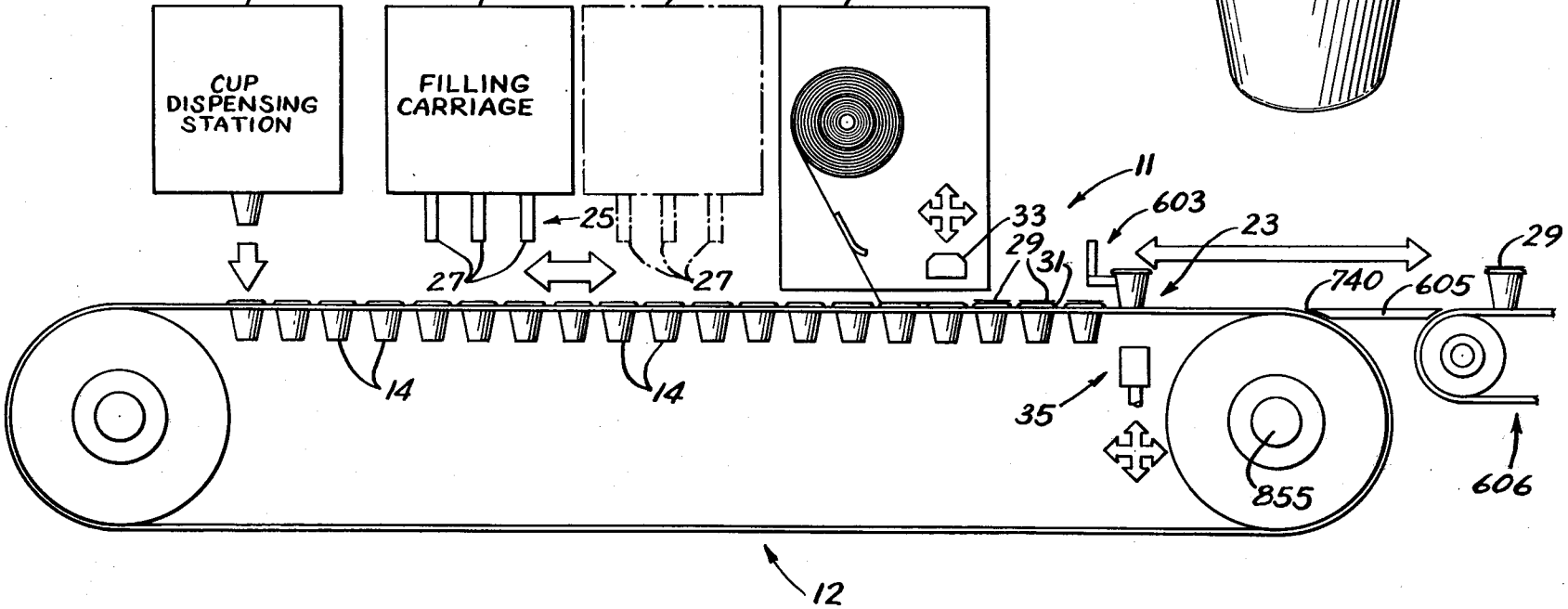
FIG. 1 is a diagrammatic elevational view of a filling apparatus embodying the novel features of the invention.

As shown in the drawings for purposes of illustration, the invention, is very generally, embodied in an apparatus 11 having a continuously moving endless flight conveyor 12 which along an upper run from left to right, as viewed in FIG. 1, receives a plurality of individual cups 14 within openings 15 (FIG. 3) arranged in a plurality of longitudinally extending rows. The conveyor 12 receives cups of a thin walled plastic kind at a container dispensing station 17 and carries the cups forward through a filling station 19, a capping station 21, and a discharge station 23 at which the filled and capped cups may be discharged to a conveying apparatus (now shown).

Figure 2:
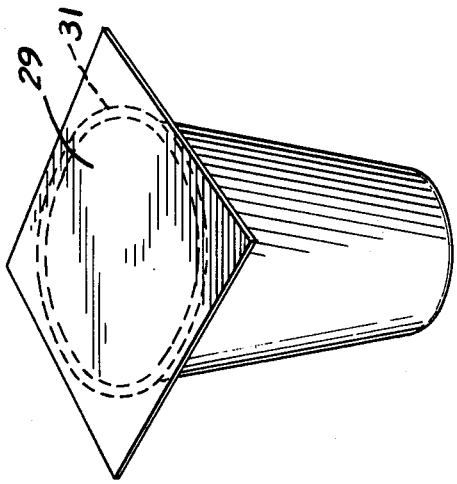
FIG. 2 is a perspective view of a cup that has been filled and provided with a hermetically sealed cover.

In accordance with the present invention, the cups 14 may travel continuously without starting and stopping as would spill the contents of comestibles in the cups and slow the rate of production of the apparatus. To achieve a filling of the cups while they are continuously moving, a filling means 25 at the filling station 19 travels forwardly with the group of cups while discharging liquid comestibles through nozzles 27 into the group of cups. The filling means 25 subsequently reverses its path of travel to fill a next subsequent group of cups on the continuously moving conveyor. At the capping station 21, individual caps or covers 29 (FIG. 2) are secured to rims 31 of the cups 14 while the cups are continuously moving and a movable heat sealer means 33 heat seals the covers 29 to the rims while traveling forward therewith prior to reversing the direction of travel for succeeding cups. At the discharging station 23, an elevating and discharging means 35 raises the cups from the openings 15 and transfers the cups from the conveying means 12. Thus, it will be seen that the flight conveyor 12 and the various filling, capping means and discharging means may operate while the cups are continuously moving to provide a fast and steady output of filled and capped cups at the discharge end of the apparatus.

Figure 3:
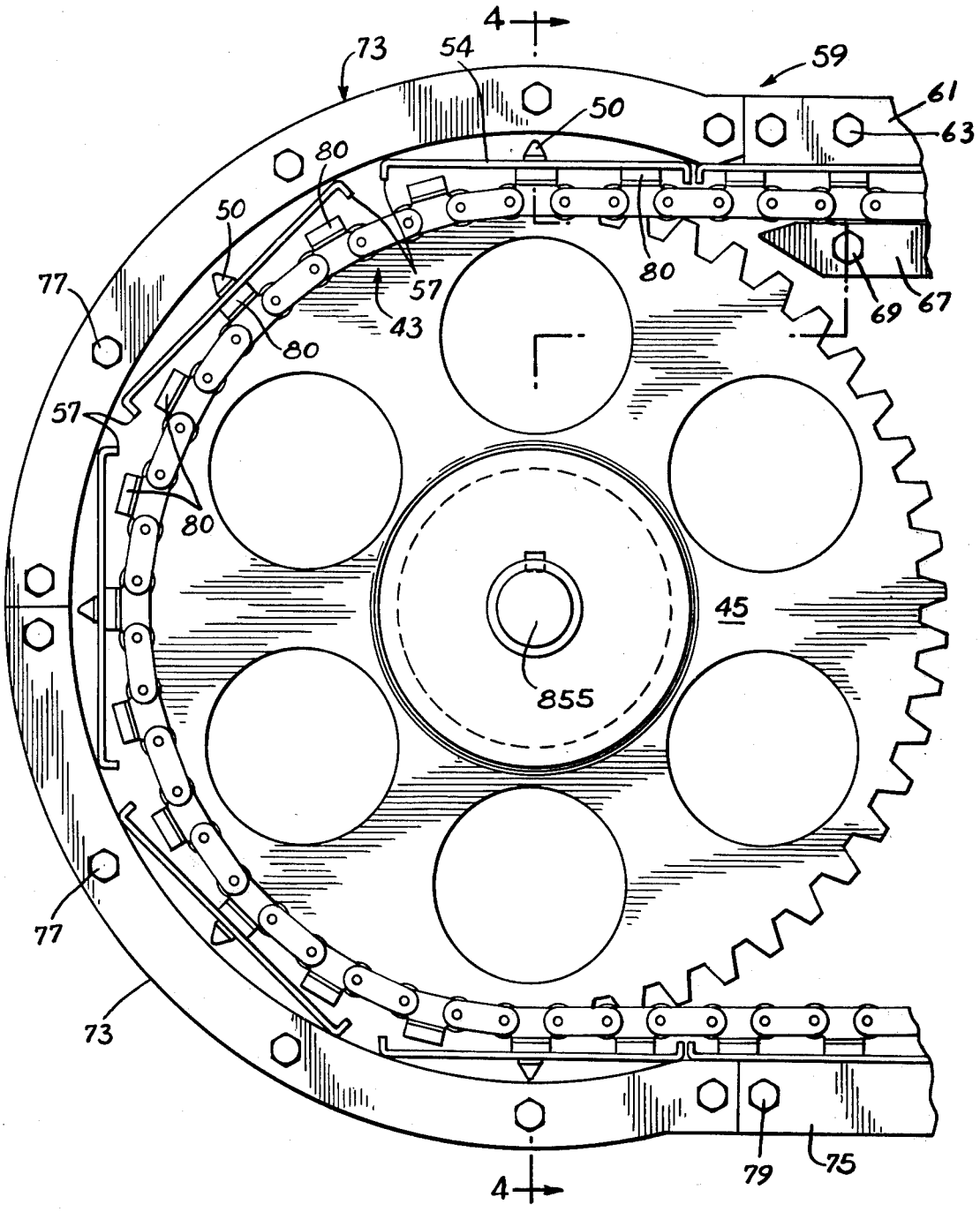
FIG. 3 is an end view of a conveyor drive sprocket.
Figure 4:
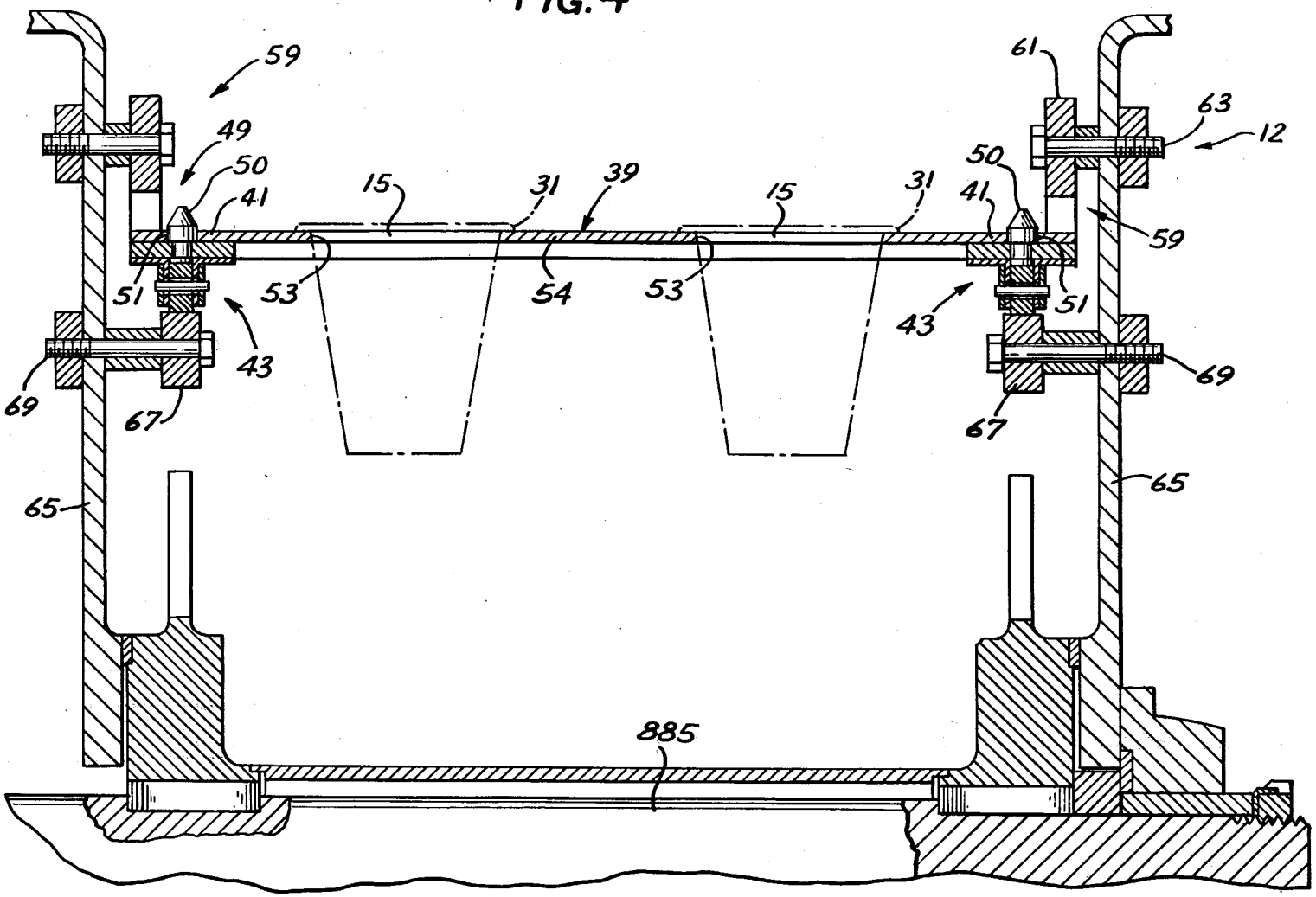
FIG. 4 is a fragmentary cross sectional view through the conveyor and conveyor sprockets.

Referring now in greater detail to the individual elements of the illustrated embodiment of the invention, the illustrated flight conveyor 12 comprises a series of individual cup supports 39, as best seen in FIGS. 3 and 4, fastened along opposite longitudinally extending edges 41 to a pair of endless bands or chains 43 for travel in a generally horizontal plane along an upper run from an inlet sprocket 45 to an outlet sprocket 47 at which the cup supports 39 turn in an arcuate path to return along a lower horizontal return run. For the purpose of facilitating the use of various sizes of cups, the illustrated cup supports 39 are releasably secured to the endless chains 43 by retaining means 49 in the form of pins 50 projecting upwardly through and having a tight frictional fit with the walls of holes 51 formed centrally in each of the cup supporting ends 41. In this instance, the cup supports 39 each have a pair of openings 15 of a diameter less than the diameter of a rim 31 for each cup. The cup openings 15 are defined by a short truncated conical wall 53 encircling the thin wall of the cup while the cup rim is held by the flat planar plate section 54 of each cup support. In this instance, the cup supports are generally flat planar metal plates having tranversely extending and downwardly turned flanges 57 at the forward and rear edges of the plate sections 54 to stiffen the same.

To assure that the plates travel and are retained on the retaining pins 50 throughout their travel without becoming misaligned as would cause any problems at the various stations, the cup supports 39 are guided throughout their length of travel by a cam guiding and confining means 59. The illustrated cam guiding and confining means 59 comprises upper horizontally extending cam or guide bars 61 secured by fasteners 63 to vertical side frames 65 to overlie the marginal edges 41 of the cup supports 39 as they travel along the upper run from the inlet to the discharge end of the conveyor 12. Along the upper run of the conveyor, the chains 43 are supported by lower chain guides 67 which are horizontally disposed and parallel to the upper cams 61 so that the chains 43 and cup supports 39 are confined therebetween during their travel through the various stations along the upper run of the conveyor. The lower chain guides 67 are likewise secured by suitable fastener means 69 to the side frames 65. In this manner, the cups may be transported along a level horizontal plane for a smooth passage at a substantially constant velocity.

At the respective inlet and outlet sprockets 45 and 47 for the apparatus, the chains 43 ride on the respective sprockets while corners 71 of the cup supports 39 ride and slide about an arcuate path as defined by arcuate cam guides 73, as best seen in FIG. 3, which extend from the upper cam bar 61 to the lower guide bar 75 which extends horizontally and is parallel to the upper guide bar 61. As the marginal edges 41 of the plates slide along the lower guide bars 75, the chains which are now resting on the inverted cup supports 39 need not be guided along their return run. The arcuate cam guides 73 are fastened by suitable fasteners 77 to the side frames 65 and the lower guide bars 75 which are fastened by similar fasteners 79 to the side frames 65. Thus, it will be seen that the cup supports 39 will be confined and supported by the cam guiding and confining means 59 throughout their travel in both the forward and reverse directions of travel. In order to replace the cup supports 39 with a similar set of cup supports having different diameters 14, one of the cam guide bars 61 or 75 is removed to allow access and removal of the cup supports 39 from the retaining pins 50 and the placing of a new support 39 on the receiving pins 50 on the chains.

To provide a more stable support for the cup supports 39 alternate chain links are provided with upstanding pads 80, as best seen in FIG. 3, having flat planar surfaces 81 to abut the underside of an associated support plate section 54 at three longitudinally spaced positions along the opposite marginal edges 41 of the cup supports 39. The center one of each of the three pads 80 has secured thereto the pin 50 for insertion into an opening in the cup support 39.

At the cup dispensing station 17, the cup supports 39 pass about the inlet sprocket 45 to a generally horizontal position beneath a cup dispensing means 83 at which nested cups 14 are held in a stacked condition for release one at a time into the openings 15 in the continuously moving cup supports 39 passing therebeneath. To assure that each cup is positively stripped from the lowermost position in the stack and drops into an opening 15, the cup dispensing means 83, as best seen in FIGS. 5–9, comprises spirally grooved dispensing gears or cams 85 of generally conventional construction and further comprises lower stripper means 87 (FIG. 7) to force positively the lower most cup downwardly to the conveyor in contrast to a mere release or dropping which may be thwarted by friction or static electricity holding the lowermost cup from falling directly.

Figure 5:
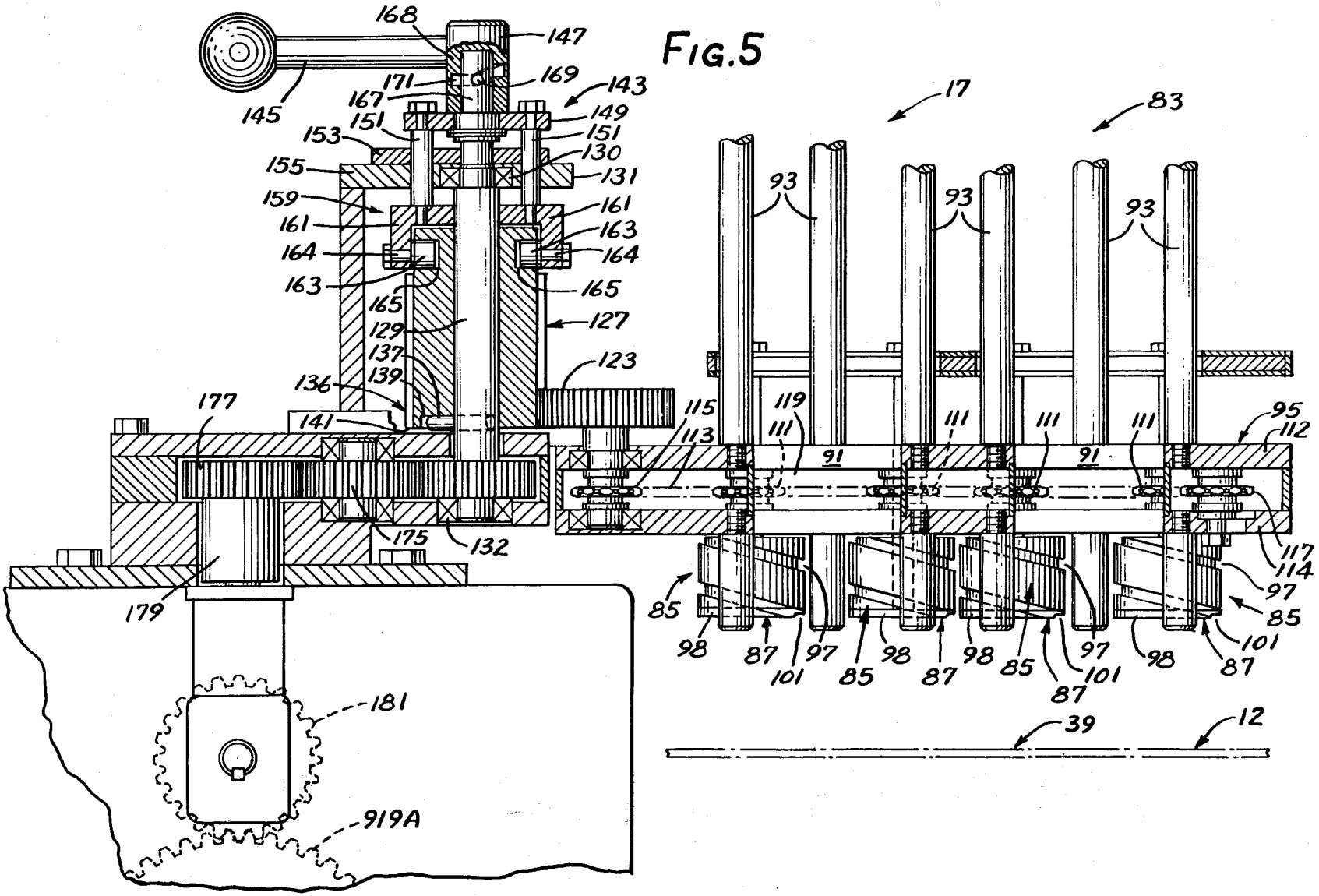
FIG. 5 is a partially section view of the cup dispensing mechanism.
Figure 6:
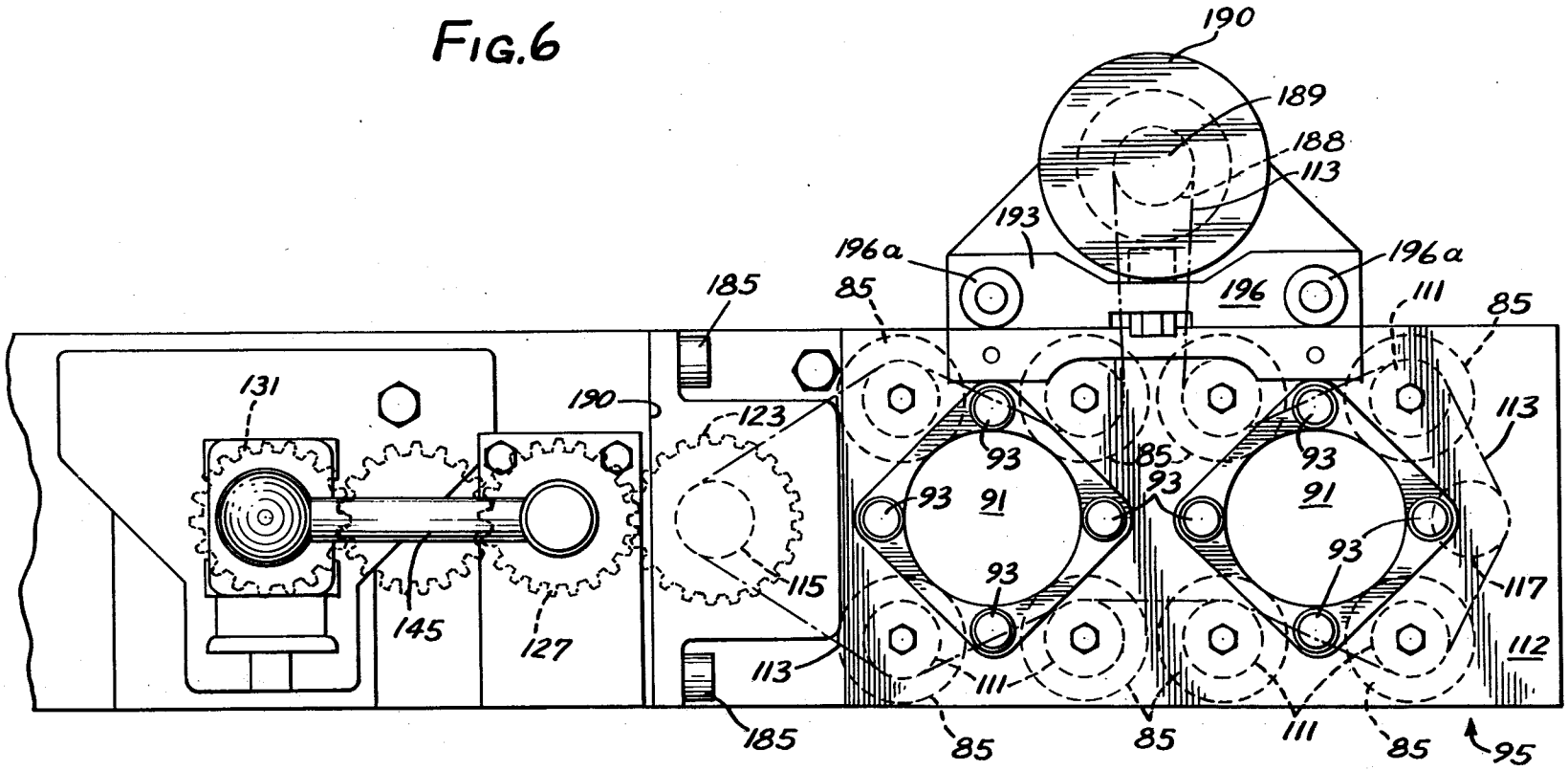
FIG. 6 is a plan view of the cup dispensing mechanism of FIG. 5.

As best seen in FIGS. 5 and 6, the four spiral dispensing gears 85 are grouped about a cup discharge opening 91 through which the cups will drop from a stack 86 of cups centered within upstanding stacking rods 93. The stacking rods are fastened to a central frame means 95 and are equally spaced about the cup discharge opening 91 in the central frame means 95.

Figures 7, 8:
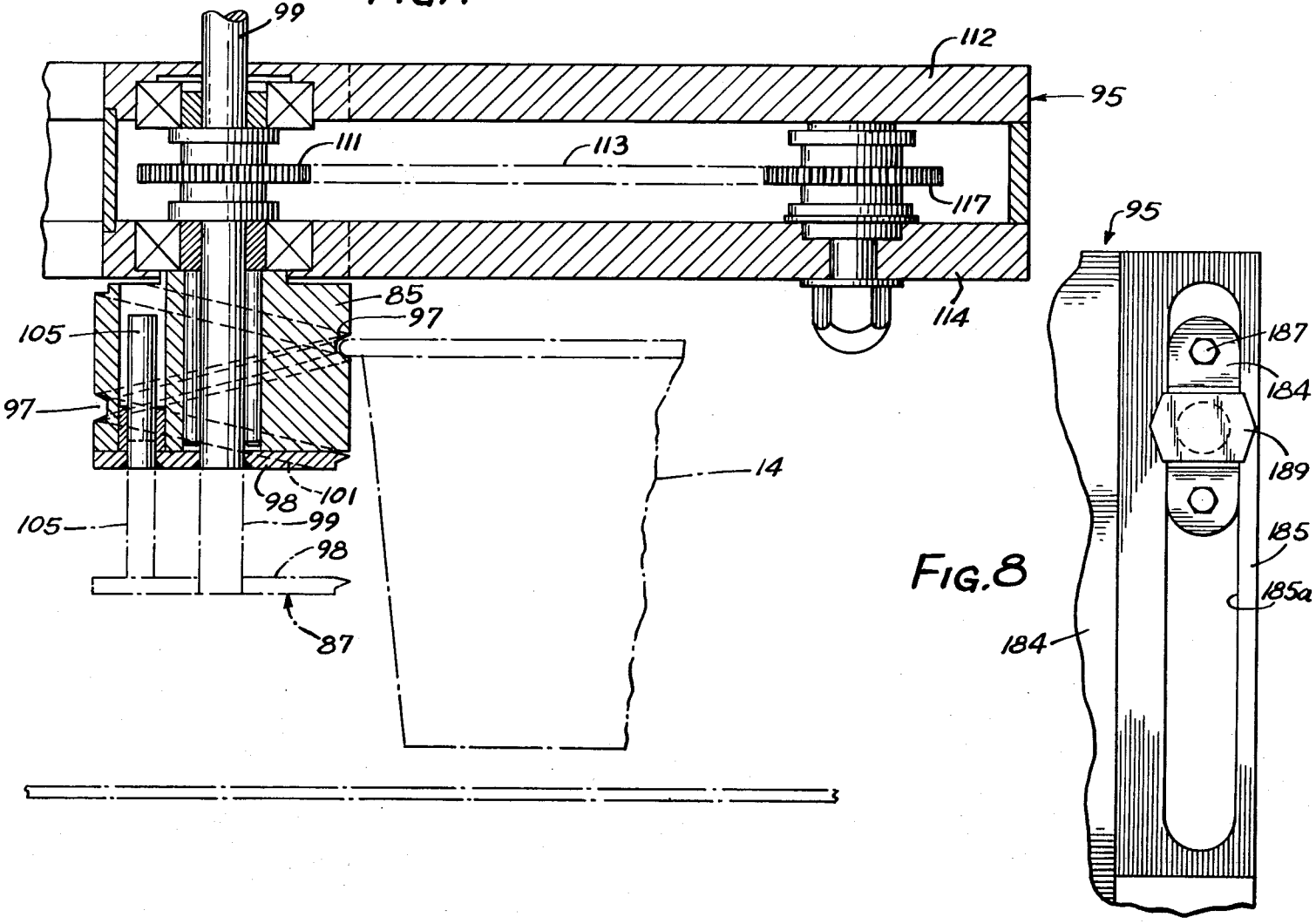
FIG. 7 is an enlarged fragmentary view of a cup dispensing spiral gear and cup stripper means.
FIG. 8 is an enlarged fragmentary view of means for shifting and locking the cup dispensing means.

To dispense a cup 14, the dispensing gears 85 turn simultaneously with the rim of the lowermost cup entering and lowering with a spiral cam groove 97 in each of the respective dispensing gears all in a conventional manner. However, rather than releasing the cups from the lower ends of the spiral gears 85 in the conventional manner, the cups are carried downwardly by cup stripper means 87 which assure that the lowermost cup does not remain because of static electricity or because of a frictional engagement between the nested side walls of adjacent cups. The cup stripper means 87 comprises a disk-shaped cup stripper 98 secured to the lower end of a rod 99, as best seen in FIG. 7, which travels vertically within a hollow bore 100 of each gear 85 to reciprocate its cup stripper 98. The latter has a groove 101 therein which is a continuation of the groove 97 for receiving the cup rim and exerting a downward force thereon to assure release of the cup from the dispensing gears 85 and the cups thereabove. To maintain alignment of the groove 101 in the cup stripper 98 with the groove 97 in its associated dispensing gear 85 when the stripper 98 is lowered as a locating pin 105, is fastened to the top of cup stripper is projected into receiving bore 107 in the lower end of the gear 85.

The sets of spiral gears 85 for lowering the lowermost cup 14 from a cup stack are driven by a common drive means comprising a sprocket 111 secured to each of the gears at a position between space plates 112 and 114 defining the frame means 95. The four sprockets 111, as best seen in FIGS. 5 and 6, are driven by a common drive chain 113 which is looped about an input drive sprocket 115 and then about four sprockets 111 on one side of the frame means 95. To allow tightening adjustment of the chain 113, an outer idler sprocket 117 is mounted at the opposite end of the frame means 95 in a plane common to the axis of rotation of the input drive sprocket 115. The chain 113 travels within a space 119 between the plates 112 and 114 forming the frame means 95.

The drive for the chain 113 and its drive sprocket 115 includes a drive gear 123 which is fastened to an upstanding shaft 125, as best seen in FIG. 5, carrying the drive sprocket 115 which is journaled for rotation in the frame means 95. The gear 123 is meshed with a vertically movable, large gear 127 carried on a rotatable shaft 129 vertically mounted for rotating in bearings 130 and 132 in a stationary frame 131 relative to which the frame means 95 may be shifted vertically, as will be explained. When the frame means 95 is shifted vertically as when changing cup sizes, the gear 123 slides vertically along the teeth of the large gear 127 while remaining meshed therewith.

Sometimes, it is desirable to disable the cup dispenser to allow service or work on the apparatus while it is running but without cups being dispensed. To disable the cup dispensing operation, a clutch means 136 is provided for coupling or uncoupling the gear 127 from its supporting drive shaft 129. More specifically, the drive shaft 129 has a driving key 137 affixed thereto for insertion into a slot 139 formed in the bottom of the gear 127 to abut an end wall of the slot and thereby drive the gear 127, the gear 123, the sprocket 115 and the chain 113. The gear 127 may be raised to space its bottom edge 141 above the key 137 so that the key may freely rotate whereby the cup dispensing gears 85 will remain stationary while the shaft 129 is continuing to rotate.

For the purpose of shifting the gear 127 vertically, a clutch actuating means 143 is provided comprising a turnable handle 145 fastened to an upstanding turnable cylindrical cam 147 which is fastened at its lower end to a horizontally disposed plate 149 mounted on parallel upstanding slide rods 151 slidable within the top plates 153 and 155 of the stationary frame 131. The lower ends of the slide rods 151 are connected to a top wall 157 of a yoke 159 having depending legs 161 carrying cam follower rollers 163 rotatable about horizontal axles 164 and projecting into a circular groove 165 in the top portion of the gear 127.

As best seen in FIG. 5, a stationary cam post 167 is secured as by welding to the top plate 153 and projects upwardly into a bore 168 in the cylindrical cam 147. A laterally projecting pin 169 is secured to the top of the stationary post 167; and the pin 169 projects into a cam groove 171 on the cylindrical cam 147. The cam groove 171 has an inclined cam portion between the upper and lower ends. By turning the handle 145 the cylindrical cam 147 may be turned with the walls of its camming slot 171 camming against the stationary pin and thereby formcing the cylindrical cam 147 to shift vertically relative to the pin and to push or pull the attached plate 149, rods 151, yoke 159, and gear 127, the latter is raised or lowered either to be clutched or unclutched from the key or pin 137 on the drive shaft 129 with turning of the handle 145.

The drive for the drive shaft 129 includes a lower gear 173, as best seen in FIG. 7, fixed to the drive shaft 129 at the lower end thereof and meshed in engagement with an idler gear 175 which in turn meshes with an output gear 177 of a right angle gear drive 179 driven by an input 181 extending to a large driving gear 183. The drive gear 183 is being driven in timed relationship to the conveyor 12 so that the cups are driven downwardly and dispensed when the cup receiving openings 15 are passing beneath the dispensing gears 85 and stripping means 87.

As can be best understood from FIGS. 6 and 8, the dispensing frame means 95 carrying the cup may be shifted vertically and locked at a given height and distance above the conveyor 12. As best seen in FIG. 6, the frame means 95 includes a pair of vertically extending flanges 185 which abut along a vertical interface wall 190 with a stationary column on the main frame and to the right of the conveyor. The flanges 185 secure the frame means 95 at a given height above the conveyor with the frame means 95 projecting in a cantilever fashion over the conveyor. The flanges 185 have elongated vertical slots 185a therein into which project stationary guides 186, as best seen in FIG. 8, fastened by fasteners 187 to the column 184. The stationary guides 186 carry thread studs 188 to receive threaded lock nuts 189 which extend laterally to abut flange 185. By tightening the lock nuts 189 on the studs, the lock nuts are brought to bear against the flanges 185 and force the latter tightly against the column 184 at the vertical interface wall 190, FIG. 8. By loosening the lock nuts 189, the frame means 95 may be shifted vertically with the gear 123 sliding along the gear 127 and the flanges 185 sliding along the column 184 at the interface walls 190.

Figure 9:
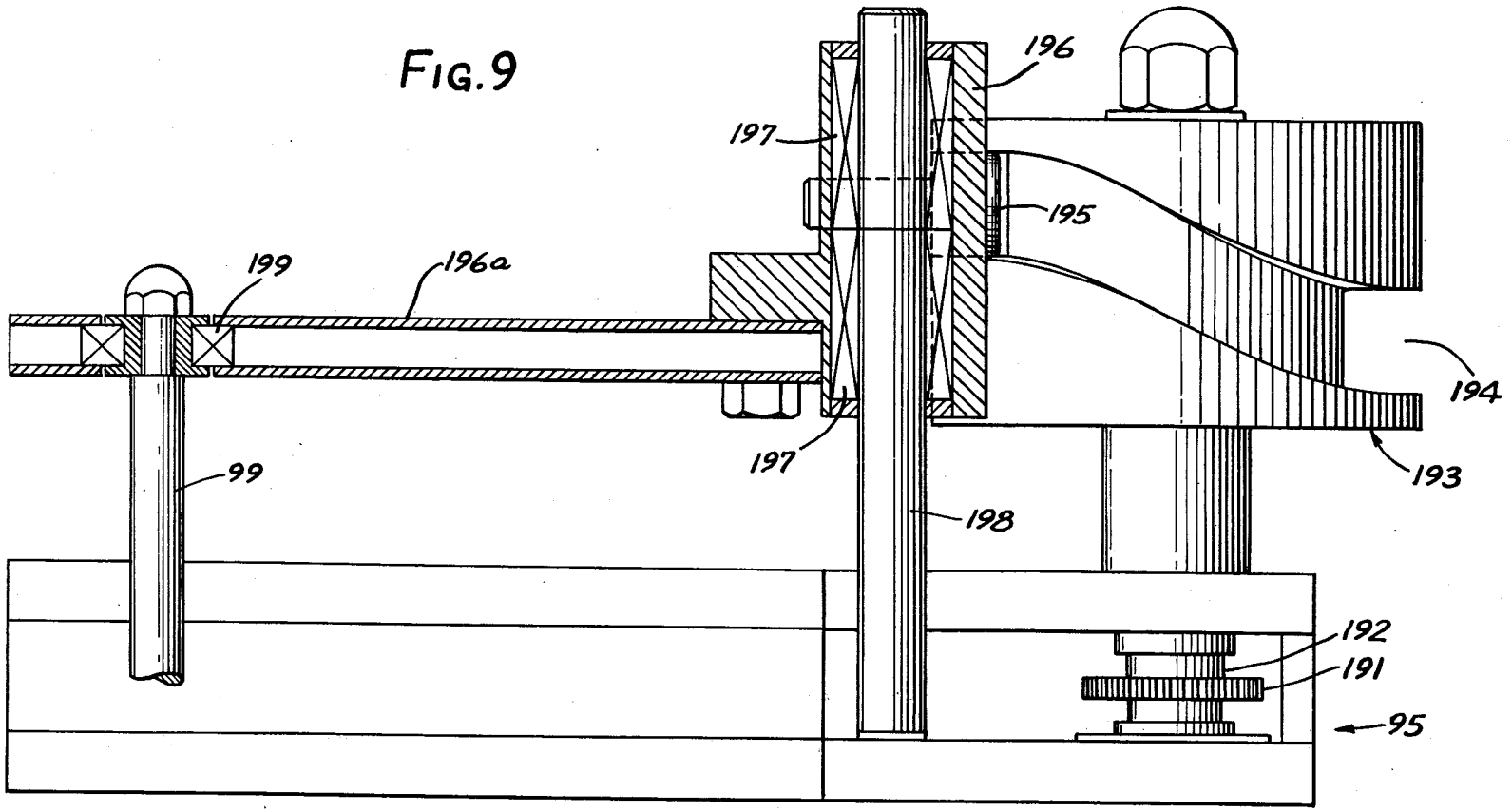
FIG. 9 is a partially section view of a cam for operating the cup stripping means.

The drive for the cup stripping means 87 including the cup stripping disks 98 will now be explained in connection with FIG. 9. As best seen in FIGS. 6 and 9, the driving chain 113 for the dispensing gear sprockets 111 extends into a sprocket 191 mounted on a shaft 192 carried by the frame means 95. On the upper end of the shaft 192 is secured a barrel cam 193, FIG. 9, having a spiral cam groove 194 into which projects a cam follower 195 carried on a vertical movable connector and guide plate 196. The guide plate 196 carries a pair of vertical slide bushings 197 through which project a pair of upstanding support and guide rods 198 secured at their lower ends to the frame means 95. To the guide plate 196 is fastened horizontal plate **196*a* having bearings 199 supporting and journaling the upper ends of the stripping rods 99 on the plate 196*a*. As best seen in FIGS. 6 and 9, the plates 196 and 196*a* are guided and supported for vertical movement relative to the frame means 95 by the upstanding rods 198. Thus, it will be seen that as the chain 113 turns the sprocket 191 and the cam 193 in timed relationship to the rotation of the dispensing gears 84 that the plates 196 and 196*a* are shiftedvertically to raise and lower the same and they in turn raise and lower the stripper rods 99 which carry the stripping disks 98** at the lower ends thereof.

Figure 10:
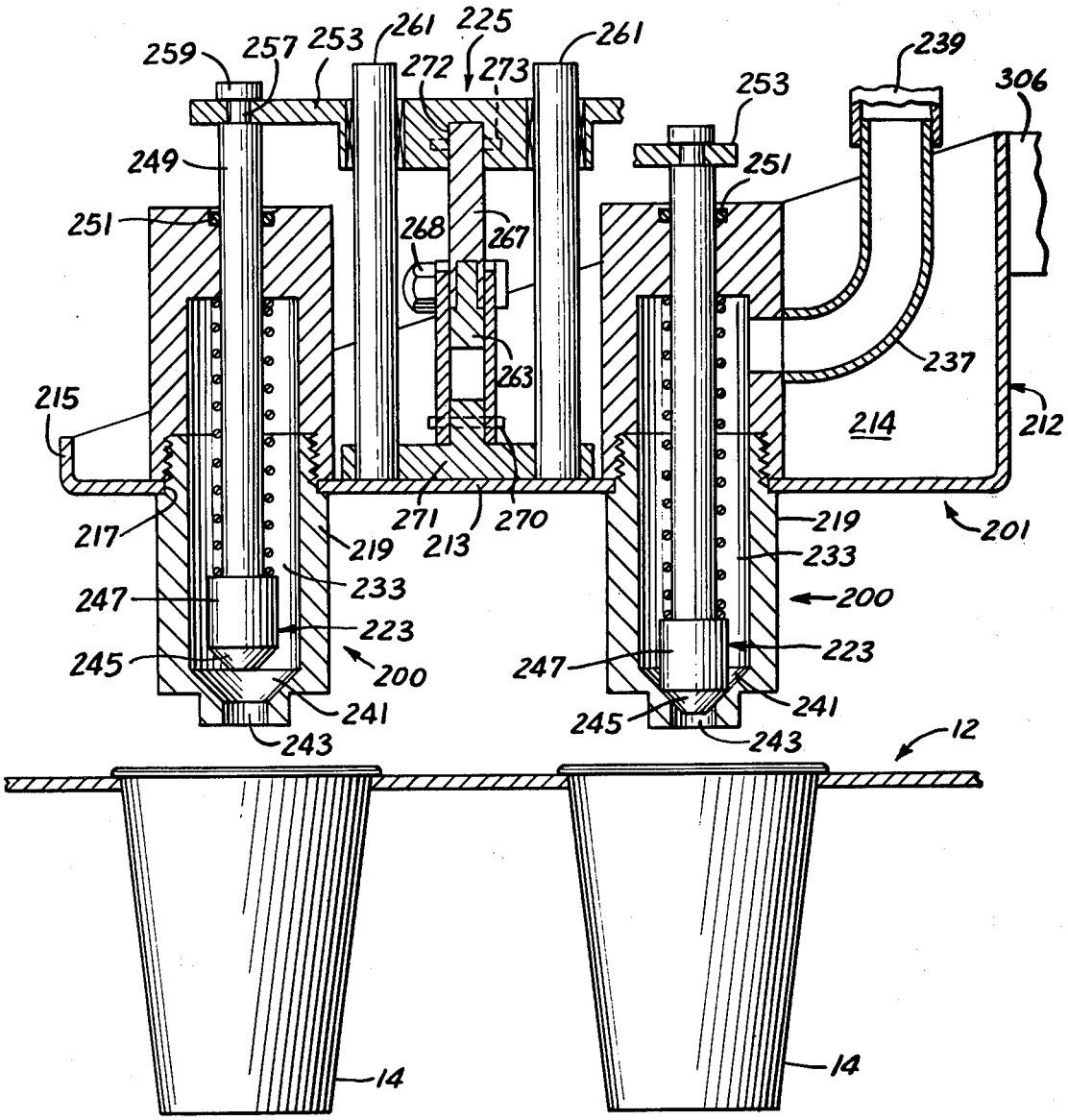
FIG. 10 is a sectional view broken at the right-hand portion thereof to show filling nozzles in a closed position.
Figure 11:
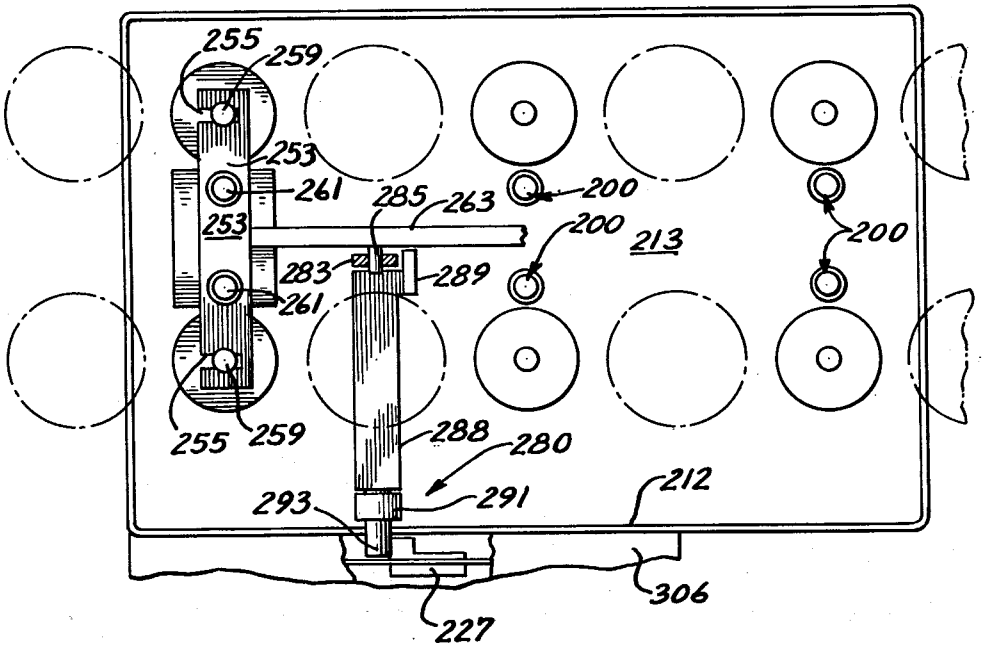
FIG. 11 is a plan view of the toggle actuating mechanism for the valves of the filling nozzles.

The conveyor 12 carries the cups 14 continuously forward without stopping to the filling station 19 at which the filling means 25 fills a plurality of cups, six in this instance, while traveling forwardly with the six cups and then returning to fill the next group of six cups. At the filling station, as best seen in FIGS. 10 and 11, comestibles are discharged simultaneously through a plurality of nozzles 200, in this instance there being two rows each with three nozzles extending longitudinally over one of the rows of cups on the conveyor. The nozzles 200 are carried in a carriage 201 which travels forwardly with the cups while filling six cups and then returns to fill the succeeding group of the six cups. In this instance, the carriage 201 is guided for rectilinear sliding movement along a first guide or slide bar 205, FIG. 12, which is mounted on brackets 207 to extend upwardly above a portion 209 of the stationary main frame to which the lower ends of the brackets 207 are affixed. The carriage 201 is generally in the form of a tray 211, as best seen in FIG. 10, having a rear upstanding wall 212 joined integrally with a bottom wall 213 from which upstand a pair of triangular shaped side walls 214 leading to a front upturned short flanged wall 215. The nozzles 200 are generally cylindrical and project through openings 217 in the bottom carriage tray plate 213 with portions of the housings 219 of the nozzles abutting top and bottom sides of the tray's bottom wall 213.

To limit the amount of material leaked or dripped during the return movement of the carriage, the preferred nozzles 200 also are provided with shut off valves 223 which are commonly operable by a toggle like mechanism 225 during the course travel of the carriage. To this end, the toggle mechanism is shifted to move the nozzles 223 to the open position at a forward stop 227 and to a closed position when reaching a rearward stop 229, the stops being carried by the stationary frame.

Referring now more specifically to the nozzles 223, the nozzles each have a hollow interior bore 223 which at the upper portion thereof is provided with a port 235 in fluid communication with an upward elbow shaped coupling 237 to which is attached an end of a flexible hose 239 leading to the metering device which supplies the comestible to the nozzle. At the lower end of the nozzle housing 219, there is formed a generally frustoconical wall 241 adjacent a discharge orifice 243 which receives a lower frustoconical tip 245 of a valve plunger 247. When the valve tip 245 is seated, as shown in the left valve of FIG. 10, the orifice 243 is closed and the carriage 200 will be traveling in the reverse direction. The right and left valves are shown in FIG. 10 in both open and closed positions for purposes of clarity. In actual operation, all six valves are simultaneously in open or closed positions.

The valve member 247 includes an upstanding rod 249 which extends through a sealed O-ring 251 upwardly to an actuating bar 253. Preverably, actuating bar 253 is provided with a necked slot 255, as best seen in FIG. 11, into which is inserted a necked portion 257 of the rod 249 with the upper head portion 259 of the rod thus extending outwardly of the neck to provide a firm positive mechanical connection to drive the rods 249 upwardly and downwardly with vertical movement of the actuating plate. In this instance, three actuating bars 253 are provided and each is guided for vertical movement by means of pairs of upstanding guide rods 261 of generally cylindrical shape having lower ends fastened to the bottom wall 213 of the carriage tray.

The toggle actuating mechanism for the valve means 223 includes a common longitudinally extending actuating toggle bar 263 which extends longitudinally between and is suitably attached to each of the three actuating bars 253 to move them in unison to operate their respective valves 223. More specifically, the common actuating toggle bar 263 extends longitudinally of the center of the tray and is connected by toggle linkages to each of the transversely extending, nozzle actuating bars 253. The toggle bar 263 is pinned by a center pin 268, FIG. 10, to each lower link 269 which is mounted on a pivot pin 270 fastened in upstanding brackets 271 mounted on the tray bottom wall for pivoting about the center of the axis of the pin 270. As best seen in FIG. 10, each lower link 269 is split and has fastened therebetween a portion of the actuating toggle bar 263 at a position slightly below the upper end of the lower link 269 which is pinned by a pin 268 to the lower end of an upper link 267 of each toggle linkage. More specifically, as best seen in FIG. 10, the lower end of the upper link 267 fits within the bifurcated upper ends of lower link 269 and is fastened thereto by the common pin 268. The upper end of the upper link projects upwardly through a vertical slot 272 in the actuating bar 253 and is fastened thereto by a pin 273 extending through an opening in the link.

When the common actuating bar 263 is shifted to the right as viewed in FIG. 11, the link 267 is pulled thereby and pivots about its lower pivot pin 270 with the pin 271 pulling the upper link 267 to pivot about the pin 273 which, in turn, pulls the common actuating bar 253 down. The downward movement of the actuating bar forces its attached valve stem shafts 249 to seat the conical valve members 245 against the valve seats 241. On the other hand, when the common bar 263 is shifted to the position illustrated in the left hand portion of FIG. 10, the links 267 and 269 again resume the in-line vertical toggle position in which the pins 270, 268 and 273 are aligned in a common vertical plane holding the actuating bar 253 up with the valve stems 249 lifted and spacing the valve members 245 from the valve seats 241. In this position, the valve will be open and dispensing.

Figure 13:
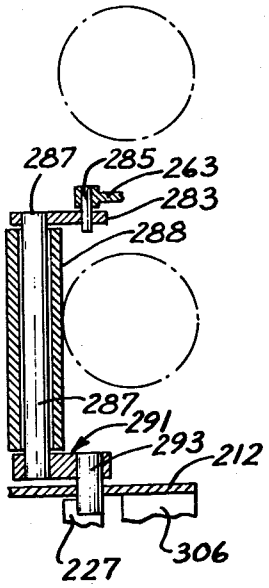
FIG. 13 is a sectional view showing a portion of the toggle mechanism of FIG. 11.

Means 280 are provided for shifting the actuating bar 263 to open and close the nozzles 223 in timed relationship to the travel of their carriage 200. Herein, a crank member 281, as best seen in FIGS. 11 and 13, is formed at one upstanding yoke 283 into which projects a horizontally extending pin 285 fastened at its inner end to the common actuating bar 253. The yoke 283 is secured at its lower end to a horizontally disposed shaft portion 287 of the crank member 281 which is mounted for turning within a bore of cylinder 288 fastened at one end to a block 289, FIG. 11, secured to the tray bottom wall 213. To turn the shaft portion 287 in the cylinder 288, another crank arm 291, as best seen in FIG. 13, is fastened to the other end of the shaft portion 287 and carries at a position offset from the shaft's axis, an actuating finger. The latter projects in the upstanding tray wall 212 for abutting and being pivoted by a stationary stop 229 to open the nozzles 223 and another stationary stop 227 to close the nozzles and terminate filling of the cups. That is, as the tray moves the finger 293 into engagement with one of the stops 227 or 229, the latter will cause the upstanding crank arm 291 to turn the shaft 287 and thereby turn the other bifurcated crank 283 about the axis of the shaft 281 causing the captured pin 285 to shift longitudinally the common actuating bar 263. As above explained, the movement of the common actuating bar operates the toggle links 267 and 269 to shift the three valve actuating bars 253 simultaneously up to open or down to close the nozzles' valves 223. As an alternative to the foregoing means 280, the closing of the nozzles has been accomplished by use of a cam fixed to turn with a barrel cam 300, described below, which cam operates a lever which in turn shifts a shuttle, a reciprocable shuttle to one limit position when the carriage is at the location of the stop 227. When the carriage 200 returns to begin another filling operation, the stop 229 will abut the shuttle and shift it to its limit other position to hold the nozzles open to fill the cups.

Figure 12:
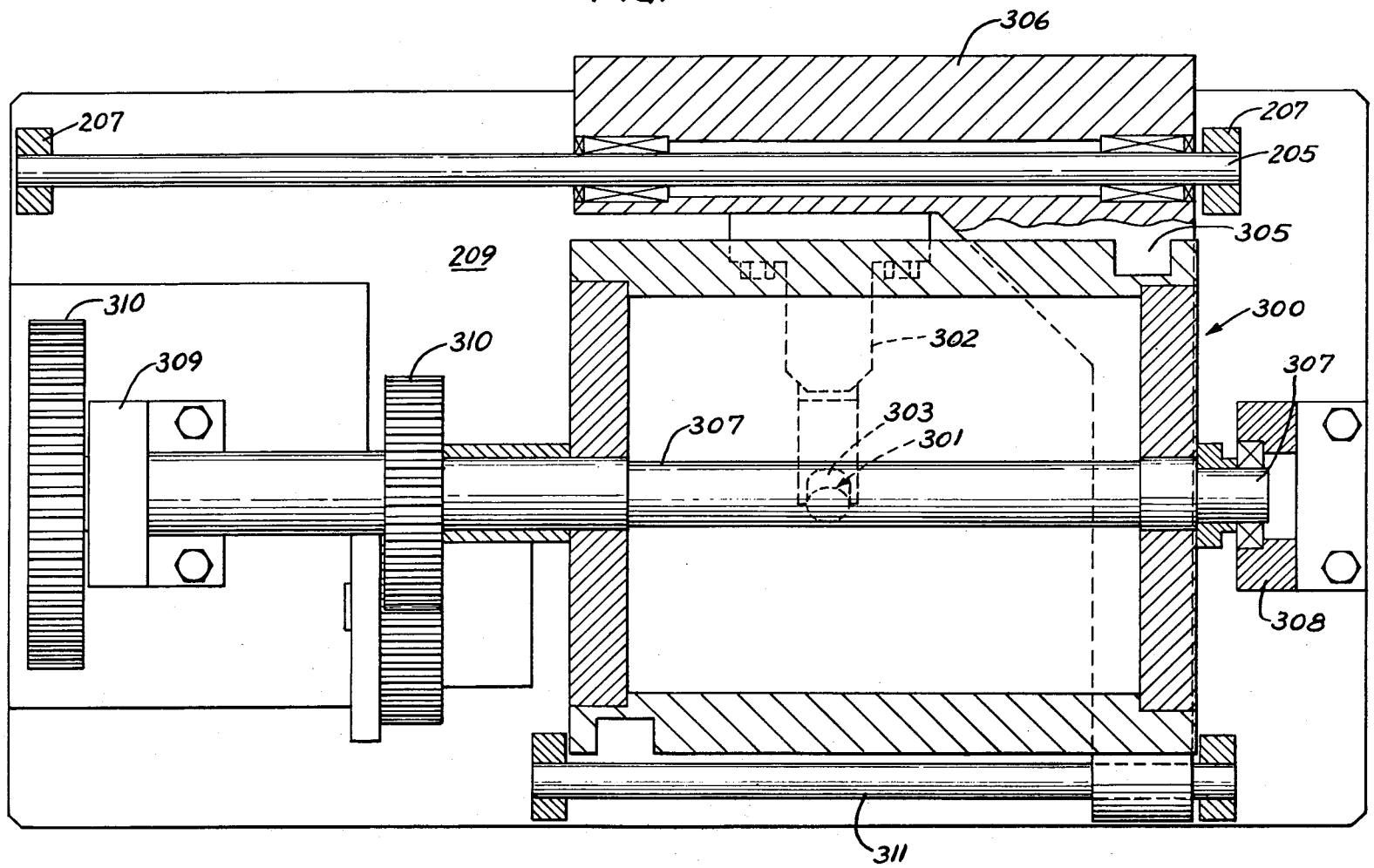
FIG. 12 is a sectional view showing a cam for driving the filling carriage.
Figure 14:
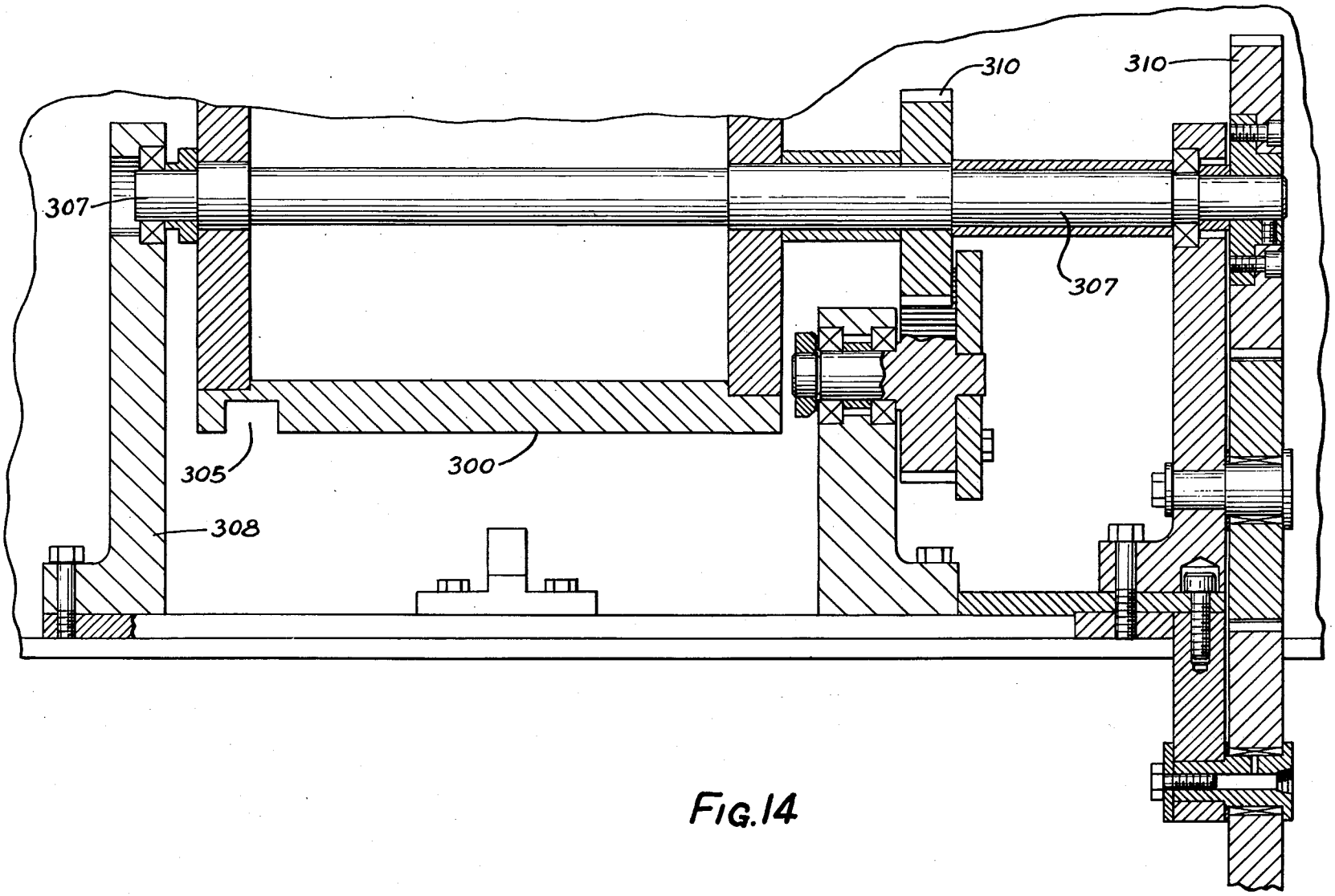
FIG. 14 illustrates a drive for the cam for driving the filling carriage.

The carriage 200 is shifted at the same speed as the conveyor travels by a cam means in the form of the rotatable barrel cam 300 which is followed by a cam follower 301 attached by a bracket arm 302 to slide member 306 to which is fastened the tray 201. As best seen in FIG. 12, the cam follower 301 includes a roller 303 which is fastened on the end of the bracket arm 302 and which is projecting into a helical cam groove 305 which is formed in the exterior of a cylindrical wall of the barrel cam 300. The cam follower roller 303 and cam follower arm 302 are secured to the slide member 306 and extend beneath the barrel cam 300. An arm 304 attached to the slide member 306 extends beneath the barrel cam 300 and has opposite end carrying a slide for sliding along a guide rod 311 and thereby hold the slide member 306 and tray 201 from turning about the axis of the slide bar 205. In this instance, the barrel cam 300 is mounted on a horizontally disposed shaft 307 mounted in longitudinally spaced upstanding stands 308 and 309 with one end of the shaft being affixed to and driven by a gear 310. The gear 310 is driven by the common drive shaft for all of the stations, as will be explained hereinafter.

The material being dispensed is often stored or is generated in an apparatus which will have a variable head of pressure and a variable feed rate therefrom. For the purpose of precisely metering the comestible being dispensed through the filling heads or nozzles 200, the latter are connected by the flexible hoses 239 to a positive displacement and metering pump means including metering pumps 313 which may be adjusted to vary the amount of comestible material being dispensed to the cups. As will be explained, the pumps 313 meter the correct amount and provide a substantially constant head for the material. By a unique pump mechanism, a single pump 313 may be used to provide a metered measured amount for each pair of nozzles and cups.

Figure 17:
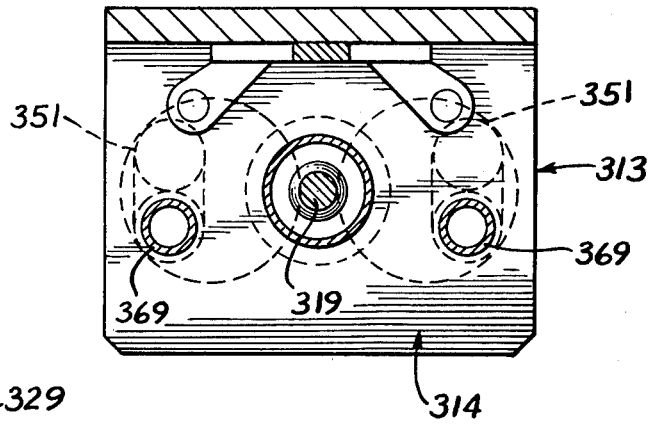
FIG. 17 is a cross sectional view taken substantially along the line 17—17 of FIG. 16.
Figure 16:
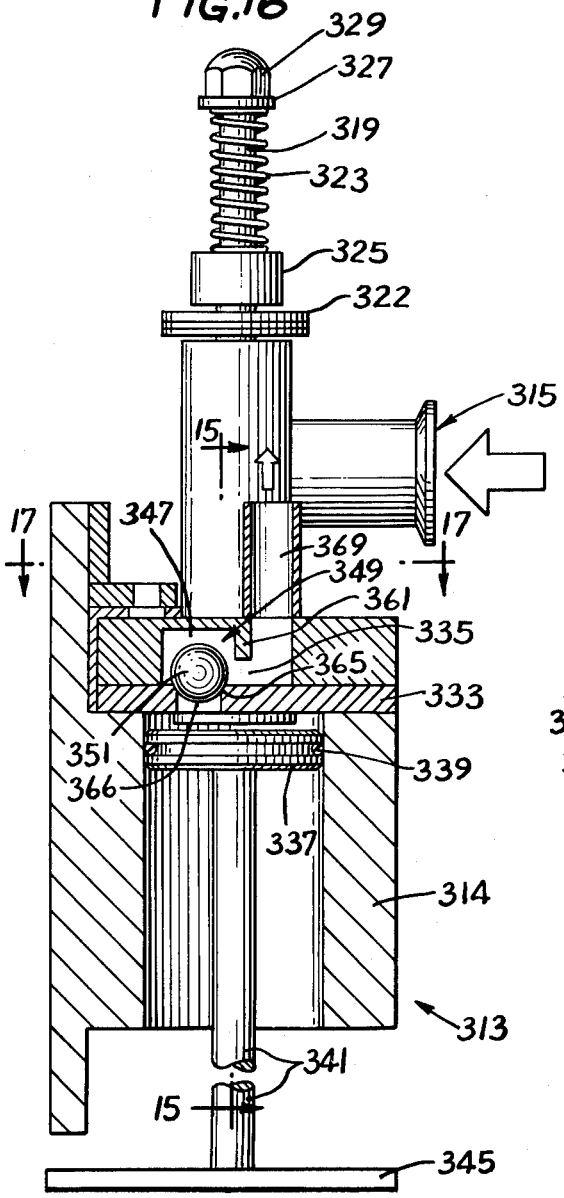
FIG. 16 is an elevational view of a metering pump.
Figure 15:
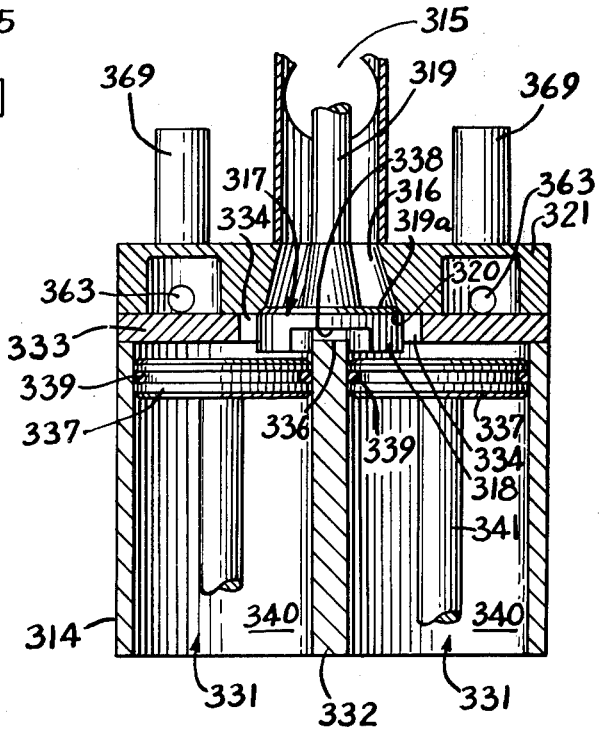
FIG. 15 is a sectional view of a metering pump taken substantially along the line 15—15 of FIG. 16.

The illustrated positive displacement and metering pump 313 is fastened to the rear wall of the apparatus and has a series of pump housings 314 secured to the wall with an upper inlet fitting 315, as best seen in FIGS. 15, 16 and 17, positioned for connection to the source of comestible supply. The material is drawn inwardly through the inlet 315 into an upper centrally located bore 316 in the housing 314 when a check valve 317 is opened by the force of the comestible material. More specifically, the check valve 317 includes a generally circular valve member 318 carried on a vertically extending stem 319 with the upper surface **319*a* of the valve member 318 adapted to be abutted against a lower seating surface 320 in an upper wall 321 for the housing 314. The stem 319 extends upwardly through a gland 322 and is biased by a coiled compression spring 323 to lift to its upper closed position. More specifically, the coiled compression spring 323 encircles the stem 319 and extends between the upper end 325 of the housing 314 and a washer 327 and nut 329 threaded on the outer top end of the stem 319.**

Within the pump housing 314 are a pair of hollow cylinders or chambers 331 extending vertically and separated by a central vertically extending wall 332. A top chamber wall 333 extends horizontally across the housing and is spaced from the upper wall 321 for the housing 314 to define a central common chamber 335, FIG. 16. The wall 333 has sector shaped openings 334 therein, as best seen in FIG. 15 with the wall 332 being between the openings 334. The incoming liquid flows into the respective cylinders 331 through openings 334 as pistons 337 in the respective cylinders 331 are retracted downwardly. The bottom wall of the valve member 318 has a groove 338 to accommodate the upper end of the dividing wall 332 and the top wall of the groove 338 is spaced from the top edge 336 of the dividing wall until the piston member 318 is forced downwardly from the position shown in FIG. 15. The illustrated pistons 337 are provided with a seal ring 339 for sliding along and sealing with cylinder walls 340 and a central piston rod 341 which projects through openings in a bottom wall 343 of the housing 314. The piston rods are connected at their lower ends to a common operating bar 345 disposed beneath each of the respective housings 314. As will be explained in greater detail hereinafter, the common operating bar 345 in turn is controlled in its amount of upward displacing movement to control the amount of material forced from the pump.

As best seen in FIGS. 16 and 17, the check valves 347 preferably in form of ball check valves 349 comprise a vertically movable ball 359 which is captured in retainer or cage 361 of generally U-shaped configuration. The cage 361 has an opening 363 in communication with the bore of an outlet filtering 369 connected to one of the flexible hoses leading to the nozzles. The valve ball 359 seats in a conically shaped valve seat 365 about an orifice 366 in horizontal wall 333 at the top of the chambers 331 and during the filling operation; and the ball 359 moves upwardly to abut the overhanging portion 367 of its cage 361 when the fluid is flowing out the output fitting 369. It will be apparent that incoming comestible in the central chamber 335 will force the check balls 365 downwardly to the closing position during the filling of the cylinders 331 through the sector-shaped openings 334 and the lowered valve members. On the other hand, when the pistons 337 move upwardly, the check balls 359 rise from their valve seats 365 to the top of their cages 361 while the comestible flows through the opening 363 into the common chamber 335 and out the fitting 369.

Figure 18:
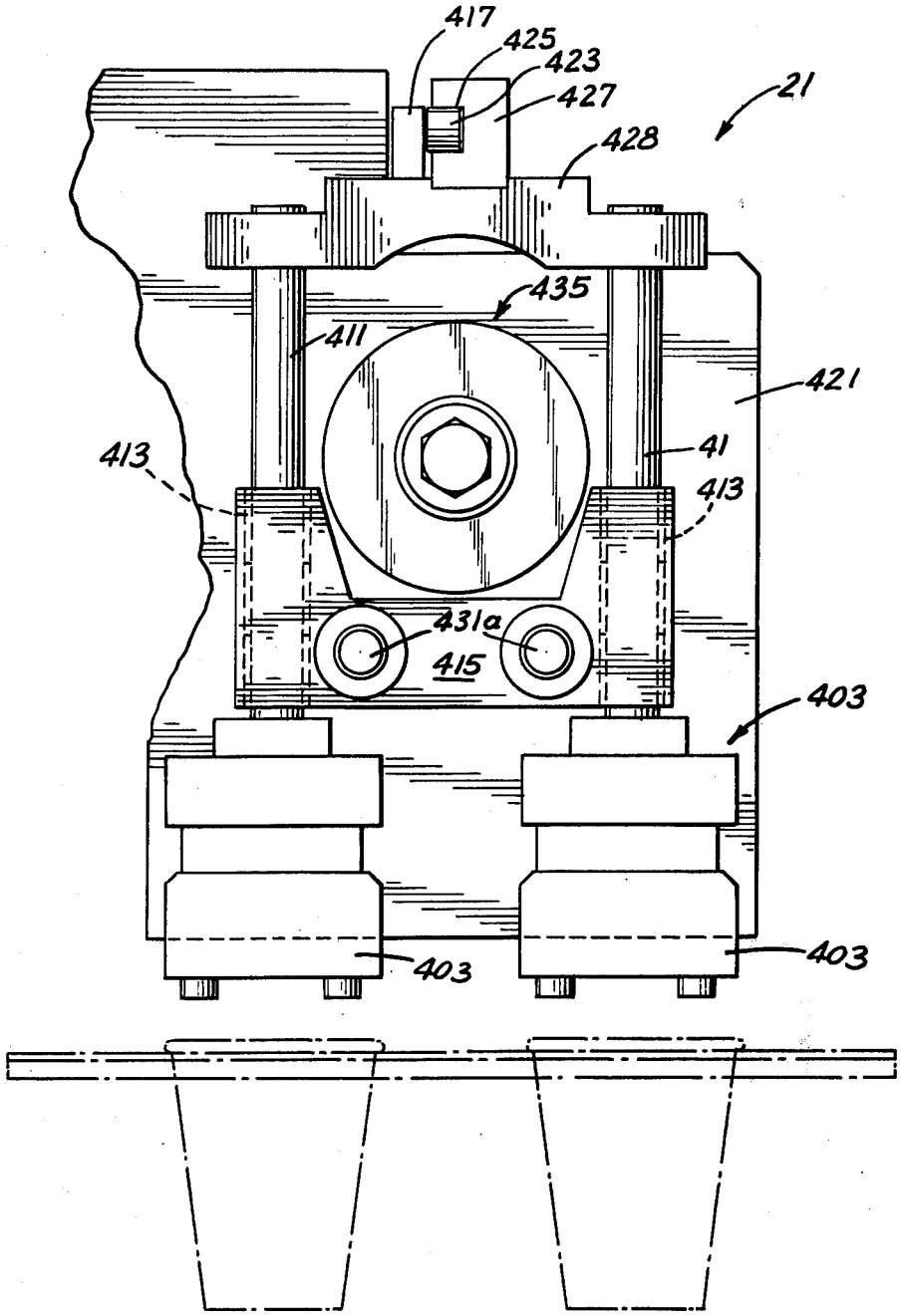
FIG. 18 is an elevational view of a heat seal mechanism for heat sealing a pair of cups while traveling therewith.
Figure 19:
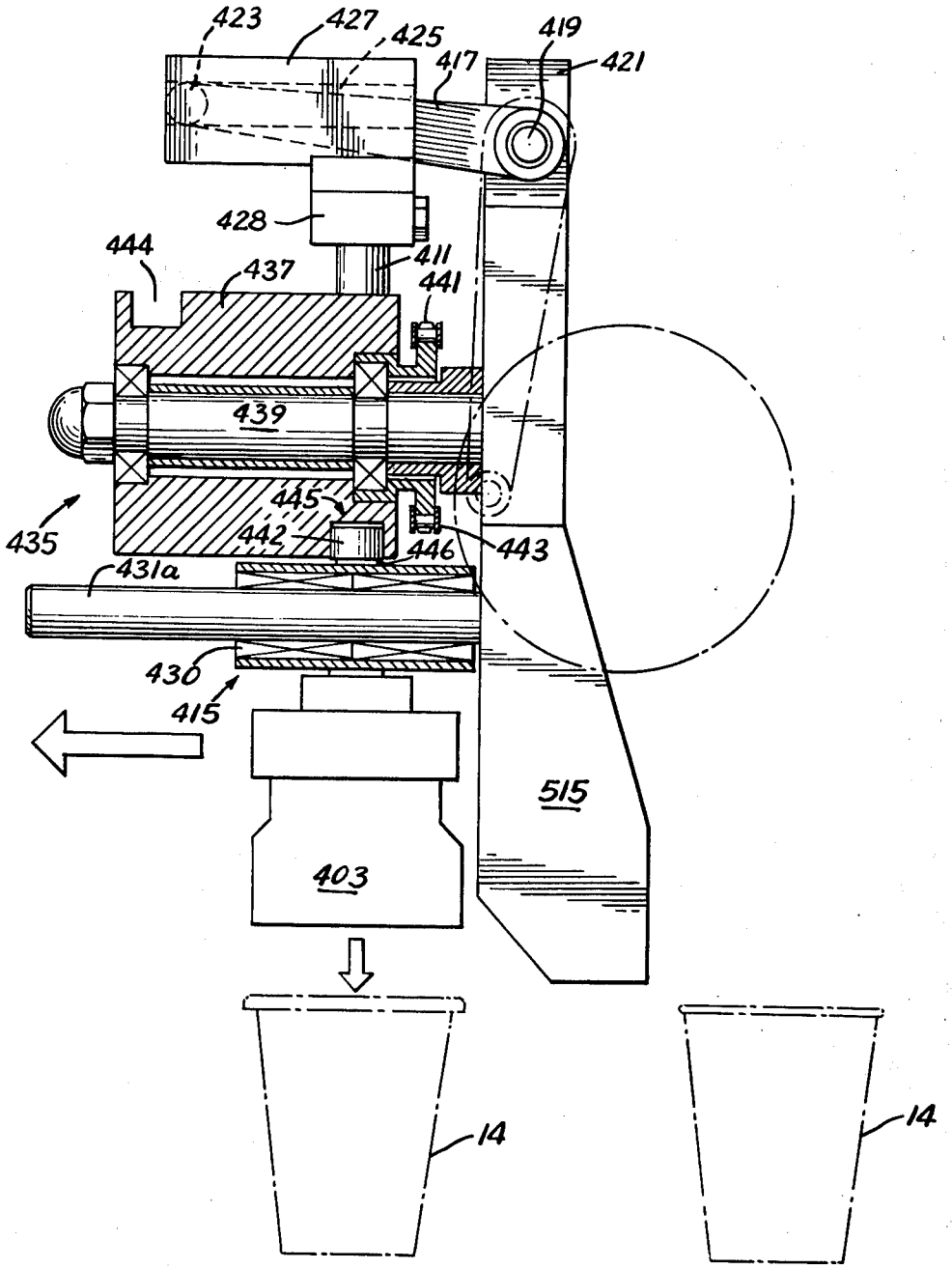
FIG. 19 is a plan view of a cam for shifting the heat seal heads longitudinally with the traveling cups.

The filled continuously moving cups on the conveyor 12 are carried from the filling station 19 to the covering station 21 at which covers or lids are heat sealed to the top rim of the respective cups 14 as they continuously travel forward through the covering station 21. In this instance, the heat seal heads 403, as best seen in FIG. 18, are also vertically reciprocatable between an upper position spaced above the covers and cups and a lower heat sealing position engaging the covers and sealing the same to the cups. More specifically, the heat seal heads 403 are fastened to lower ends of vertically movable shafts 411 which slide vertically within spaced bearing slides 413 mounted on the carrier 415 which travels horizontally in the forward direction with the conveyor carrying the heat seal heads 403 forwardly while causing the heat seal.

Figure 20:
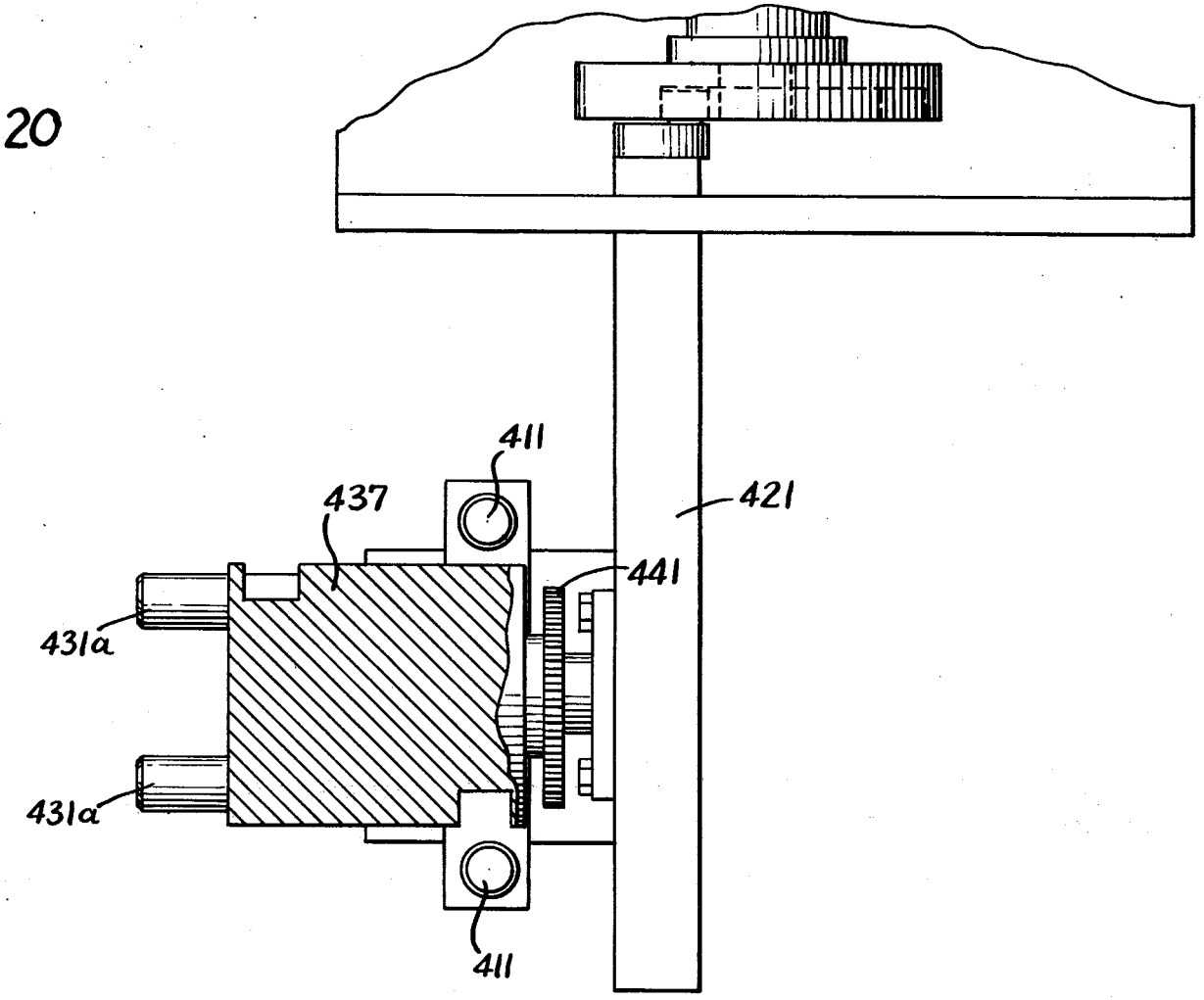
FIG. 20 is a sectional view showing the mechanism for shifting the heat sealing heads vertically and horizontally.

The preferred means for vertically shifting the heat seal heads 403 comprises an operating lever 417, as best seen in FIGS. 18 and 20, which is pivotally mounted at a pivot pin 419 to an upstanding stationary frame post 421. An outer end of the lever 417 is provided with a cam roller 423 captured within a horizontally extending slot 425 of a cam block 427 secured to cross member 428 fastened to the upper ends of the heat seal carrying shafts 411. As the lever 417 pivots in a counterclockwise direction as viewed in FIG. 20, the pin 423 acts through the cam block 427 and cross member 429 to force the two shafts 411 to slide within the two bearing slides 413.

For the purpose of moving the heat seal heads 403 in a horizontal direction, the carrier 415 has in a central portion thereof a pair of horizontally disposed bearing slides 430 through which extend horizontal stationary guide rods 431*a*. The inner ends of the rods 431*a* are fastened to the upstanding stationary frame post 421 as best seen in FIG. 20.

To shift the carrier 415 horizontally with the heat seal, there is provided a cam means 435 which includes a rotatable barrel cam 437 journaled for rotation on a horizontally extending shaft 439 which is secured at its inner end to the upstanding stationary frame post 421. The barrel cam 431 has an attached sprocket 441 which is adapted to be driven by a chain 443 as will be explained hereinafter. A helical cam groove 444 is formed on the barrel cam and an upstanding cam follower 445, as best seen in FIG. 20 projects into the groove 444. More specifically, the cam follower 445 includes an outer roller 447 turnable on an upstanding shaft 449 fixed at its lower end to the carrier 415.

Figure 21:
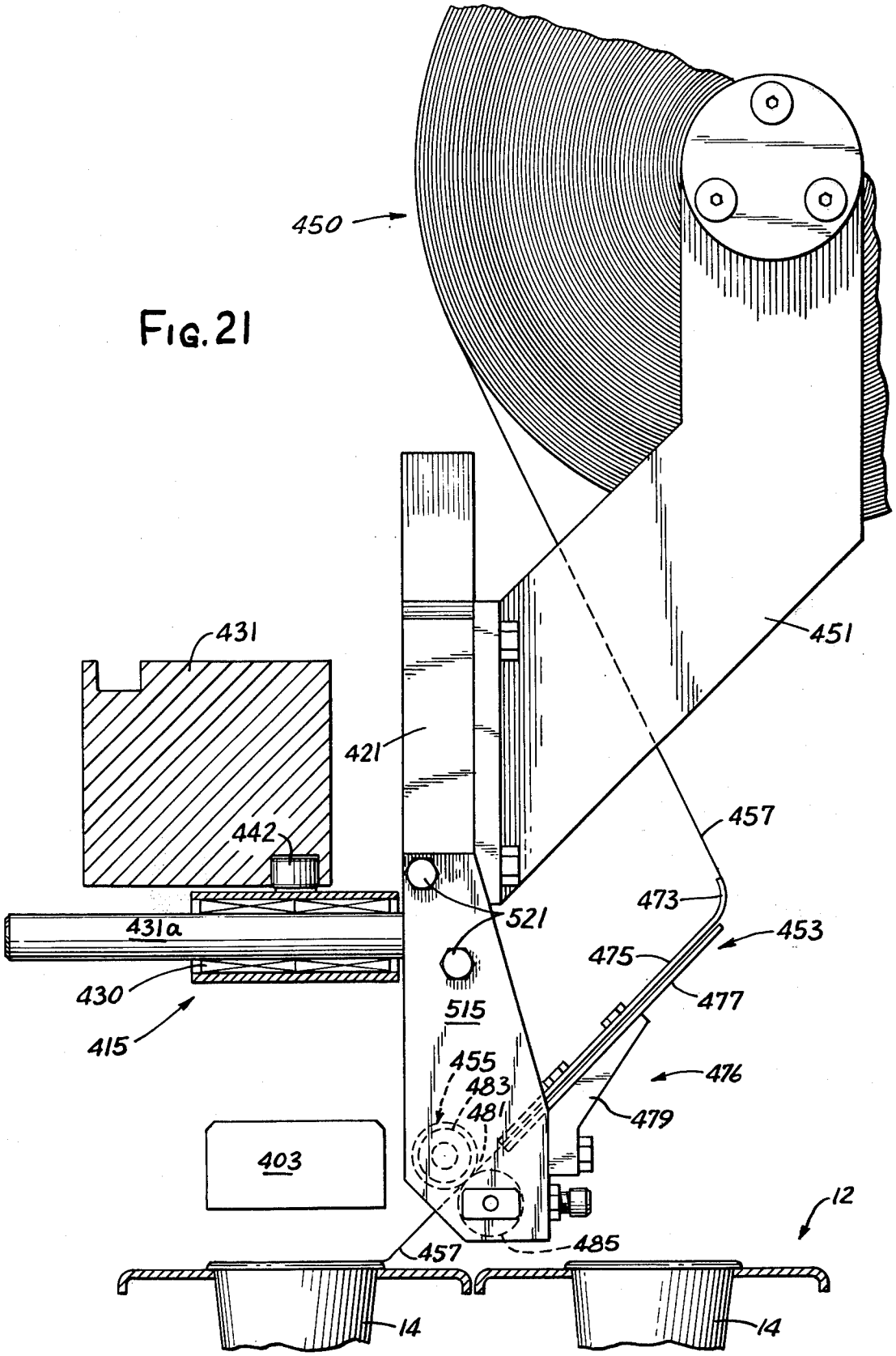
FIG. 21 is a partially sectional view of a cover feeding and coating mechanism.
Figure 22:
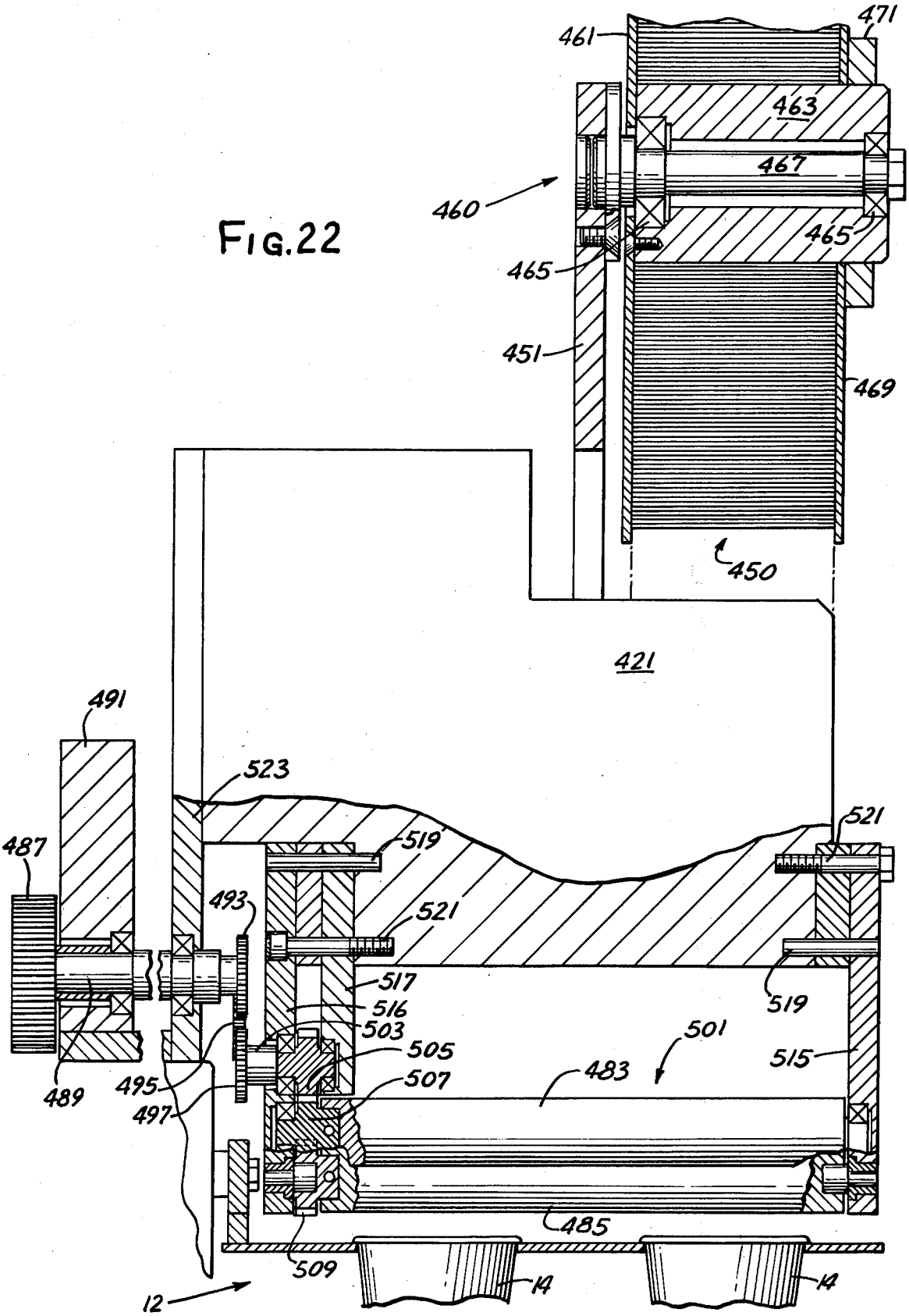
FIG. 22 is a partially sectional view of the cover feeding and applying mechanism of FIG. 21.

At the heat sealing station, the filled cups are provided with a lid or cover which hermetically seals the contents within the cups. While the lids or covers may take various forms, the preferred cover material is a paper and foil laminate with an inner metallic foil layer provided with a heat sealable coating for sealing with the rim of a plastic cup. In this instance, the cover material is provided in the form of a pair of webs 457 which are rolled to form a pair of rolls 450, only one of which is shown in FIGS. 21 and 22 and described herein, for travel downwardly to a paper guide 453 and then to a serrating means 455 which serrates the webs 457 at spaced intervals in a direction transverse to the longitudinal direction of the web. After serrating, the webs travel down to engage the cup rims and thereafter the heat seal heads 403 move downwardly and clamp the webs against the rims of the cup. The heat seal heads 403 and conveyor 12 travel at a faster speed than the web feed speed, causing the webs to tear off along the serrations, leaving the cups with individual lids or covers thereon. Herein, the cups on the conveyor travel about 6 inches while about three and one half inches of web 457 is fed forwardly. Although in the illustrations of FIG. 21 and 22, only a single roll 450 of cover material is shown for the outermost cup, a second roll (not shown) will be provided adjacent the illustrated roll 450 on the other side of the frame post 421 to cover the other cup in the same manner.

The illustrated roll 450 is mounted on a rotatable reel 460 comprising an inner flange 461 secured to a central hub 463 journaled by bearings 465 to rotate about a stationary spindle 467 secured at one end to a upstanding bracket 451 which is carried by the frame post 421 above and in general alignment with a row of cups passing therebeneath. An outer reel flange 469 is releasably mounted on the hub 463 by a suitable annular lock 471.

As the cover web 457 leaves the roll 450, it travels downwardly and is reversed in its direction of travel at the paper guide 453 which comprises a top cover plate 475 having a curved upper lip 473 and underlying stand 476 having a guide plate 477. The cover plate 475 is secured to the guide plate 477 which has a slot therein the width of the web 457. The web is confined to travel and guided along a straight line path downwardly at an angle of 45° until it discharges from between the plates 475 and 477 into an aligned nip 481 between an upper anvil roller 483 and a lower serrating roller 485.

One revolution of the anvil and serrating rollers, in this instance, results in a feed of three and one-half inches of the web 457. The web 457 is also, in this instance, three and one-half inches in width. Thus, the rollers 483 and 485 function as feed rolls to unwind the web 457 from the roll 450 and also serve to serrate the web once each revolution of the rollers.

The serrating roller 485 is, herein, about nine inches in length with a diameter of about 1.114 inch with a steel rule die cutting blade having serrating teeth of about 3/32 inch in width, the teeth being spaced at 1/32 inch interval from each other along the length of the serrating roller 485. The anvil roller has about the same dimensions as the serrating roller and is preferably chrome plated.

The drive for the anvil and cutter rollers 483 and 485 is from the common drive shaft, which is described hereinafter, which drives a right angle gear drive (not shown) for driving a gear 487, FIG. 22, mounted on a shaft 489 in upstanding stationary frame block 491. The other end of the shaft 491 carries a sprocket 493 for driving a chain 495 extending to another sprocket 497 mounted and carried by a pair of stationary vertical plates 499 and 500 of an apertured, horizontally extending guide 501 for the heat seal heads 403. This sprocket 497 is carried on one end of a shaft 503 carrying a gear 505 which, in turn, is meshed with a gear 507 carried by the anvil roller 483. The gear 505 on the anvil roller is meshed with the gear 509 on one end of the serrating roller 485 so that the anvil roller and the serrating roller are driven at the same speed and in synchronism with each other.

The heat seal head guide 501 and the serrating roller 483 and anvil roller 485 are supported by depending plates 515, 516, 517 which are fastened to the stationary vertical frame plate 421 by pins 519 and fasteners 521. The frame plate 421 extends above and transversely across the conveyor 14 and is mounted by a bracket means 523 to one side of the main machine frame.

From the heat sealing and covering station, the cups are transported by the conveyor 12 to the discharge station 23 at which a discharge means 600 including an elevator mechanism 601 raises the bottoms of the covered cups automatically to positions slightly above the conveyor while the cups are traveling forwardly whereupon a sweeper pusher 603 pushes the cups across a stationary discharge plate 605 to a discharge or take-off conveyor 606. As will be explained in greater detail, the elevator mechanism is readily adjusted to lift each of the various sizes of cups upwardly to the top of the conveyor 12. As will be explained in greater detail in connection with FIG. 28, the elevator discharge mechanism includes a movable fulcrum 607 which can be adjusted to change the stroke of the elevator lifting while the conveyor is continuing to travel. This also allows for fine adjustment of stroke to assure that the cup bottom edges clear the edges of the cup receiving holes in the conveyor 12.

Referring now to the elevator mechanism 601, the cups are abutted along their lower surfaces 609 by the top surface 610 of a vertically reciprocable elevator pad 611 carried on a cross arm 613 secured to an upper end of a vertical support post 615. The lower end of the support post 615 is carried in a vertical movable slide block 617 which is guided for rectilinear vertical movement on a pair of upstanding guide posts 619 secured at their lower ends to a traveling carrier 621. As will be explained in greater detail, the carrier 621 is guided for travel in a horizontal direction while the cups are continuing to be moved forwardly, which is to the right in FIG. 23.

Figure 23:
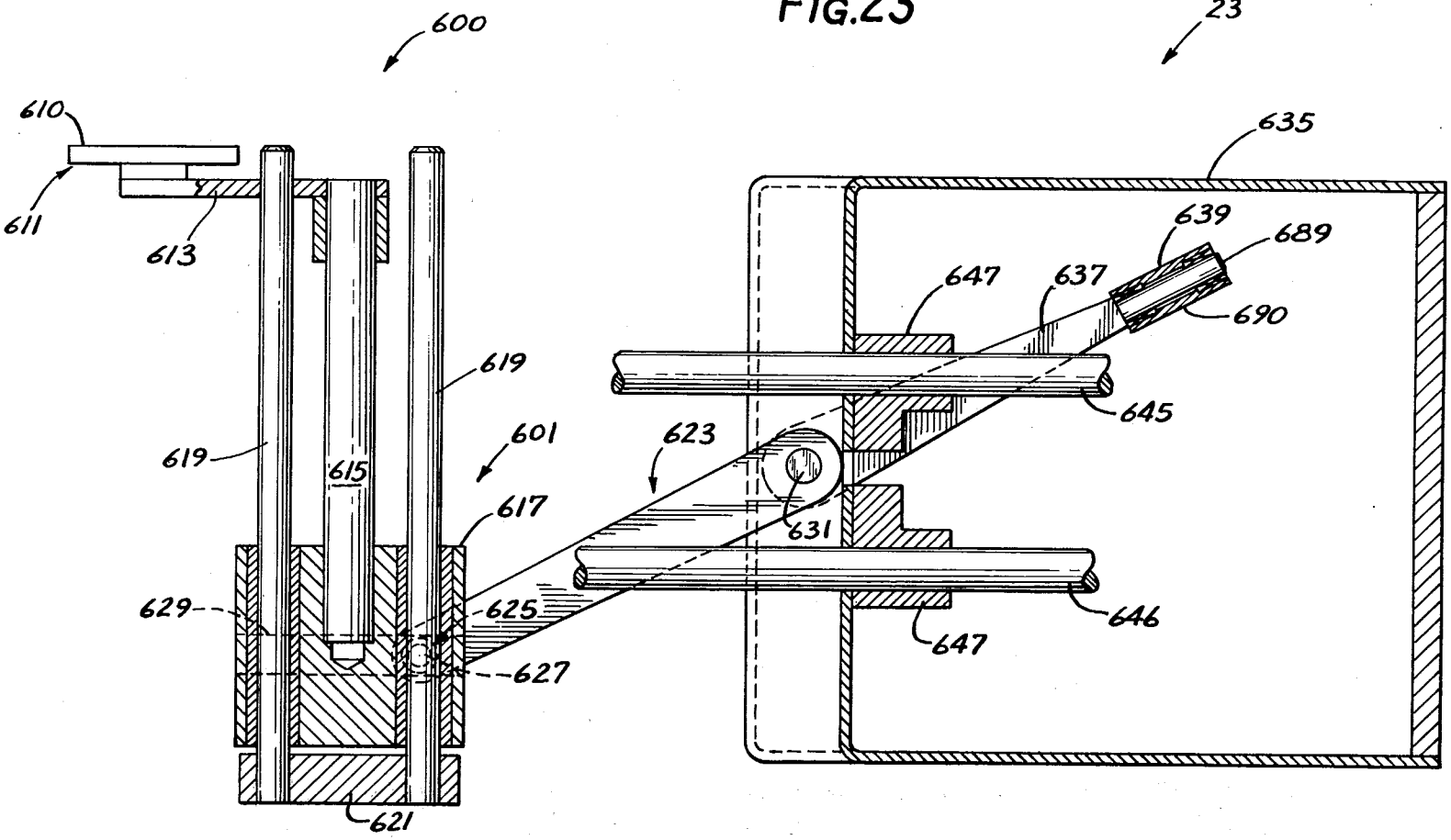
FIG. 23 is a partially sectional view of an elevator mechanism for the cups.
Figures 24, 25:
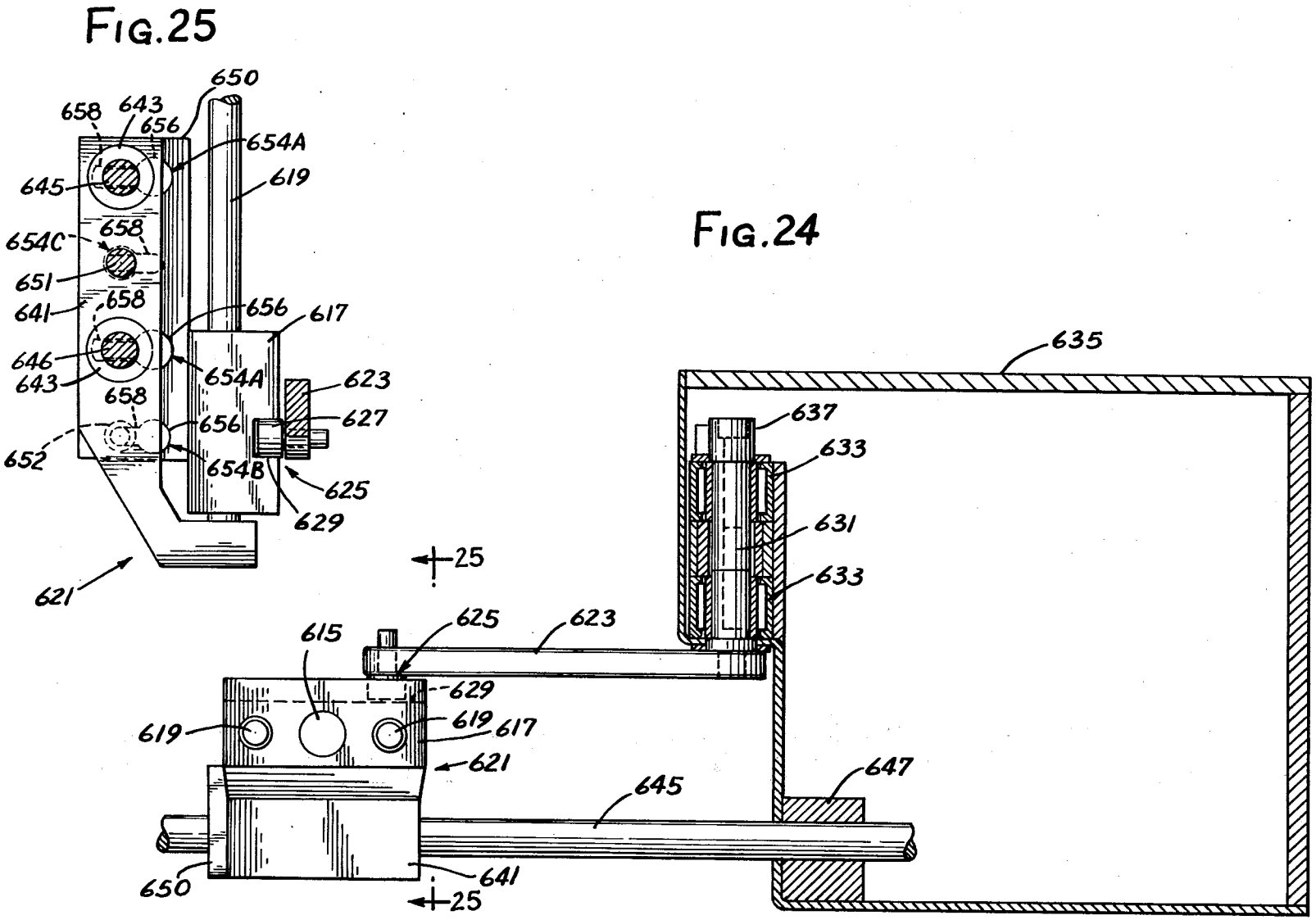
FIG. 24 is a partially sectional view of the elevator mechanism of FIG. 23.
FIG. 25 is a sectional view taken substantially along the lines 25—25 of FIG. 24.

The slide block 617 is raised and lowered with pivoting of an actuating lever 623 which is connected thereto by a cam follower 625 movable in a cam slot 629 in the slide block 617. The cam follower 625 includes a roller 626 carried on a pin 627 fixed to the free end of the actuating lever 623. The roller 626, as best seen in FIGS. 23, 24 and 25 projects into a horizontally extending groove 629 on an inner side of the guide block 617. The cam follower 625 and cam slot 629 thus convert arcuate movement of the actuating lever 623 into vertical movement of the slide block 617 without binding therebetween and allows the guide block to travel horizontally relative to the actuating lever 623. The other end of the actuating lever 623 is fixedly secured to a horizontally extending rock shaft 631 journaled in bearings 633 of a stationary frame 635. Attached to the other end of the rock shaft 631 is a lever 637, as best seen in FIG. 23, which has a connection at its outer free end 639 to the movable fulcrum operating mechanism 607 shown in FIG. 28.

As best seen in FIGS. 24 and 25, the mounting block 621 carrying the vertical posts 619 for the slide block 617 is generally an L-shaped member having a vertical leg 641 which has a pair of horizontally disposed slide guides 643 through which projects a pair of vertically spaced parallel support rods 645 and 646. These guide rods 645 and 646 extend through mounting blocks 647 (FIGS. 23 and 24) in the frame 635.

To reciprocate the carrier mounting block 621 on the bars 645 and 646, a push-pull rod 651 which may be connected to one end of the upstanding leg 641 of the carrier mounting block 621, as best seen in FIG. 25, to cause the latter to reciprocate therewith.

The preferred connection between the push-pull rod 651 and the carrier block 621 is by means of a plate 650 fastened by a lock bolt 652 to a vertical side wall of the carrier block 621. The plate has a plurality of apertures 654A, 654B and 654C therein of generally T-shaped configuration with a large diameter portion 656 and a smaller square portion 658. The ends of the push-pull rod 651 and the ends of stationary guide shafts 645 and 646 are provided with annular grooves therein to receive a portion 658 of the apertures in the plate 650. More specifically, to connect the guide block carrier 621 to the push-pull rod 651 the plate 650 is shifted to the left-hand position shown in FIG. 25, so that the plate engages the rod at the annular groove in the push-pull rod. By tightening the lock bolt 652, the plate will remain in this left-hand position with the large diameter portion 656 of the apertures 654A and 654B aligned with the support shafts 645 and 646 to allow the guide block carrier 621 to slide freely therealong. To convert for an intermittent operation of the cup conveyor 12, the lock bolt 652 is unscrewed and the plate 650 is shifted to align the large diameter portion 656 of the aperture 654B with the push-pull rod 651 whereby the latter reciprocates freely through the carrier block 621 and the plate 650 without translating them therewith. In this latter position, the smaller diameter portions 658 of the outer two slots 654A and 654C are connected to the grooved portions on the fixed guide shafts 645 and 646 to positively hold and locate the carrier block 621 directly beneath a pair of apertures in the conveyor plate thereabove so that while the conveyor is stopped the cups may be moved upwardly to be moved across the dead plate prior to the next forward movement of the conveyor in its intermittent travel.

The push-pull rod 651 also extends through the block 647, as shown in FIG. 23, on the stationary frame 635 to a reciprocating cam drive means 655, as best seen in FIG. 26. More specifically, the push-pull rod 651 is fastened to and terminates in cam follower block 657 which is slidably mounted on the respective guide rods 645 and 646, as best seen in FIGS. 26 and 27. The cam follower block 657 is generally T-shaped with a centrally disposed cam follower roller 659 carried on an end of a stub shaft 661 horizontally disposed and fixed to a web 663, FIG. 27, of the block 657. The cam follower roller 659 projects into a spiral groove 667 in a rotatable barrel cam 669 which is mounted for rotation about a horizontally disposed stub shaft 671 secured to a vertically extending stationary plate 673. Also fixed to the barrel cam 669 is a gear 675 which is likewise journaled on the shaft 671, the gear 675 being meshed with and driven by a gear 674 mounted on shaft 676 which, in turn, is meshed with a larger gear 677 mounted on a shaft 678. As will be explained in greater detail, the gear 677 is driven in timed relationship to the conveyor travel to rotate the gears 674 and 675 to turn the barrel cam 669 to cause the follower 659 to move the cam follower block 657 along the stationary rods 645 and 646. When the end of push-pull rod 651 is connected to the carrier guide block 621 by the plate 650, the elevator carrier block 621 reciprocates horizontally while the elevator pad 611 is being shifted vertically by the actuating lever 623. When plate 650 is shifted to disconnect the carrier block 621 from the push-pull rod, it will merely slide without reciprocating the carrier block 621.

Figure 28:
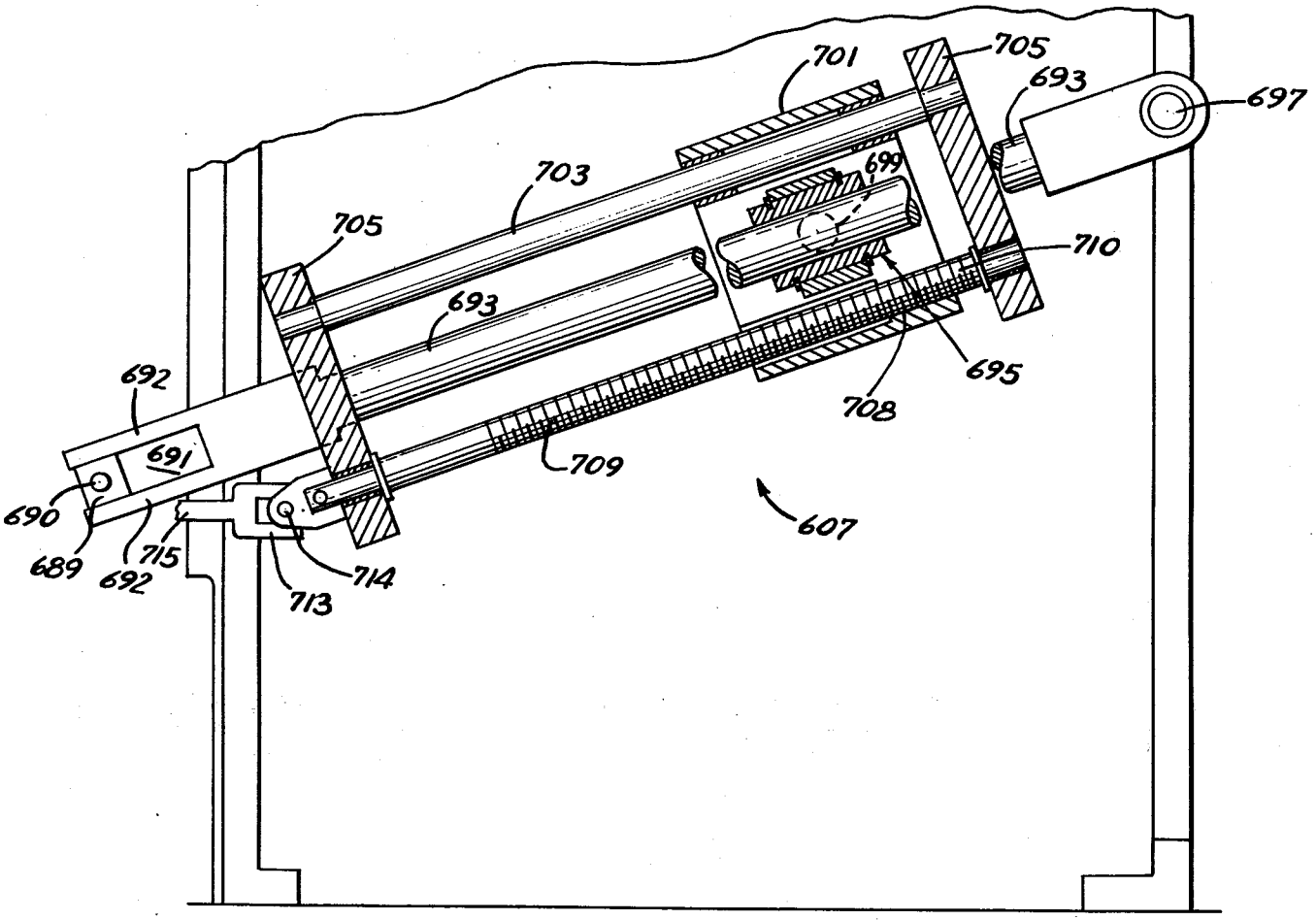
FIG. 28 is a partially sectional view of a variable fulcrum device for controlling the stroke of the cup elevator mechanism.

The movable fulcrum 607 for changing the amount of the elevator stroke will be described in connection with FIGS. 28 and 23. The upper position of the elevator pad 611 has a constant upper limit position level with the top of the conveyor plates to assure removal of all cup sizes from the elevator pads and from the conveyor 12. The lever 637 for operating the elevator block 617 has a round end 689 in a bearing block 690 which is square in cross section and is mounted in a space 691 between opposite tines 692 of a fork connection at the end of the fulcrum lever 693. The latter is pivotally mounted in a slide bracket 695 for turning about the axis of pin 699, as will be explained. The other end of the lever 693 is connected by a pin 697 to an actuating cam 731 as will be described hereinafter in connection with FIGS. 29 and 30. As best seen in FIG. 28, the fulcrum lever 693 extends through the center of the slide bracket 695 which is connected by the fulcrum pin 699 carried on a slide carrier 701. The fulcrum lever 693 turns about the axis of the fulcrum pin 699 and the latter is movable with the slide carrier 701. More specifically, the slide carrier 701 mounts the pin 699 for sliding longitudinally along a guide rod means 703 which is secured at opposite ends to space plates 705. The slide carrier 701 also is provided with an internal thread 708 into which is threaded a portion of a shaft 709. Opposite unthreaded ends 710 of the shaft 709 is journaled for rotation about its longitudinal axis in the stationary plates 705 and the left end, as viewed in FIG. 28, of the shaft 709 is connected by a clevis 713 connection including a pin 714 between the shaft 709 and a manually turnable rod 715, which may be turned manually by the machine operator. As the rod 715 is turned by the operator to adjust the elevator stroke, the threaded shaft 709 translates the slide carrier 701 along the rod means 703 thereby shifting the position of the fulcrum pin 699 relative to the pin 697 on the end of the fulcrum lever 693. In this manner, the fulcrum point for the fulcrum lever 693 may be shifted so that for the same amount of displacement of the lever end 697 by the cam 731, the vertical component of displacement of the forked tines 692 may be changed to increase or decrease the arc through which the actuating lever 623 pivots and thereby the extent of vertical travel of the elevator pads 611.

Figures 29, 30:
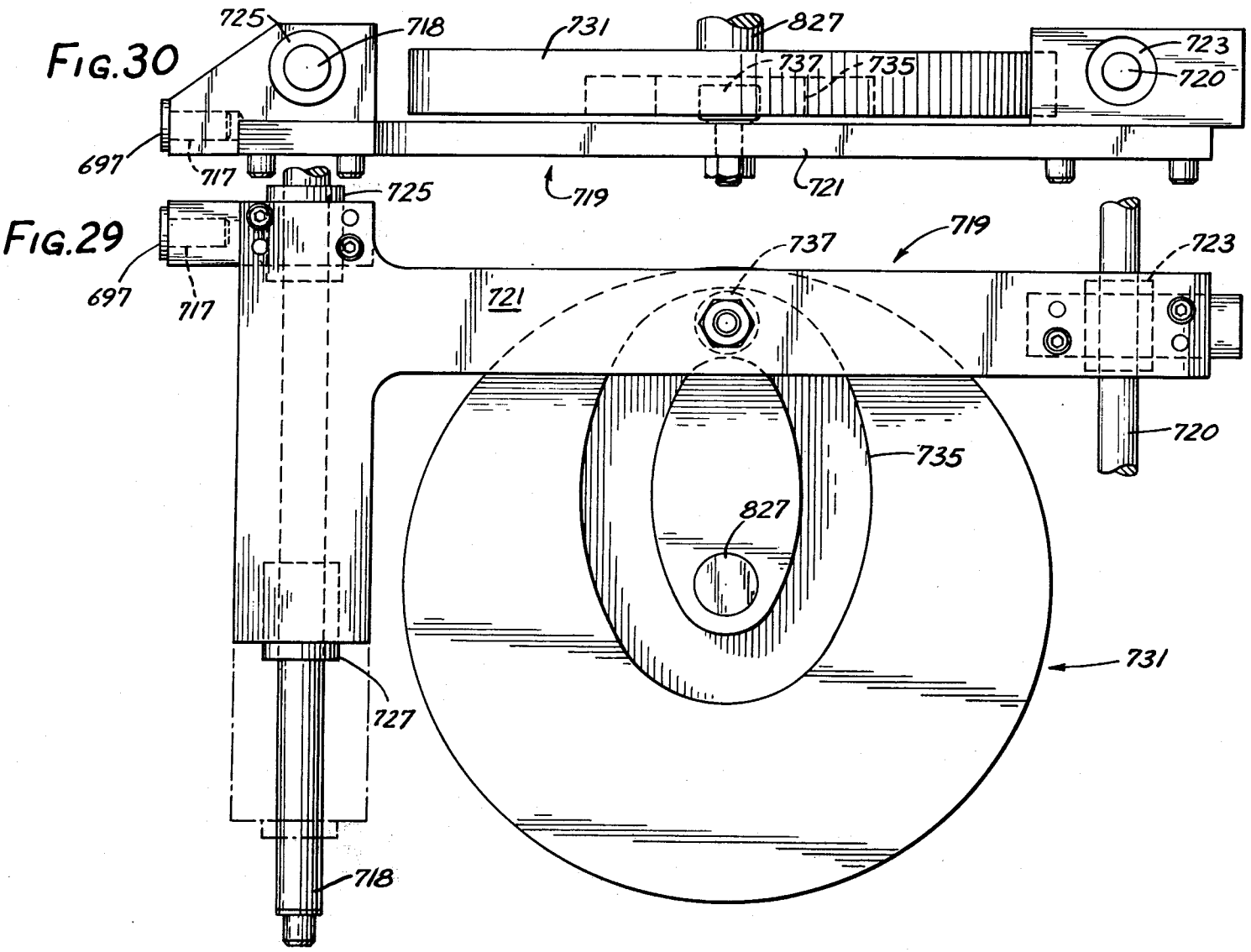
FIG. 29 is a view of a cam and slide for driving the variable fulcrum device and elevator mechanism.
FIG. 30 is a plan view of FIG. 29.

The connector pin 697 on one end of the fulcrum lever 693 projects at right angles from the view shown in FIG. 28 into a bore 717, as best seen in FIGS. 29 and 30, of a vertically translating slide 719 which is constrained to reciprocate along a pair of vertically extending stationary guide rods 718 and 720 fastened at upper and lower ends to the main machine frame. The translating slide 719 includes a cross bar 721 which carries a first slide bearing 723 encircling the guide rod 720. A pair of vertically spaced slide bearings 725 and 727 encircle the other guide rod 718 and are suitably fastened to the translating carrier 719 to assist in the rectilinear guiding constraint of the carrier 719 by the cam 731.

As best seen in FIGS. 29 and 30, the translating carrier 719 is driven by a large circular cam 731 which is connected to a central horizontally extending support shaft 732 for turning about an axis of the latter. A cam slot 735 is formed in one vertical side wall of the cam 731 and a cam follower 737 carried by the cross bar 721 and projects into the cam slot 735. Therefore, as the cam 731 rotates, the cam follower 737 is driven thereby to convert the rotary movement of the cam into a vertical movement of the translating carrier 719 and thereby a vertical movement of the connector pin 697 carried by the fulcrum lever 693.

As previously explained, the take-out pusher or shuttle 603 serves to push each discharging pair of filled and sealed cups across the stationary stripper or dead plate 605 and onto the takeoff conveyor 606. When the cups are raised upwardly from the apertures in the conveyor by the elevator mechanism, the shuttle 603 will be directly behind the cups and move forwardly to abut the rear edges of the raised cups adjacent and prior to the cups coming closely adjacent to a leading pointed edge 740 of the dead plate 605 to push the cups across this dead plate 605. In this instance, the shuttle 603 includes a generally horizontally extending bar 741 having V-shaped grooves 743 in the leading edge thereof to assist in guiding the cup forwardly in a straight line when engaging the rear edges thereof. The bar 741 is generally flat and rectangularly shaped and attached to the lower end of an upwardly extending rod 743 secured centrally thereof. The rod 743 has a vertical slot 745 into which projects the end of set screw 746 threaded in a block 747 to lock the height of the shuttle 603 at the desired height relative to the conveyor. The block 747 has a vertical bore 749 receiving the rod 743 and permitting the same to be shifted vertically before the set screw 746 is tightened against the rod to lock the shuttle at a given height above the conveyor. Thus, for various heights and sizes of cups, the shuttle may be quickly and readily adjusted vertically.

To move the shuttle 603 rectilinearly and in timed relationship to the speed of the conveyor 12, a slide 749 is provided having an arm 751 projecting therefrom extending to the block 747 supporting the shuttle. The arm projects horizontally over the conveyor from an opening 753 in a sheet metal housing 755 of a stationary frame and includes an inner, bent, right angle portion 756 secured to a portion 757 of the slide 749. The slide 749 has a bore 761 receiving the bent portion 756 of the arm 751 and a set screw 763, FIG. 31, threaded in the slide abuts and locks the arm 751 to the slide 749.

The slide 749 is guided for horizontal rectilinear movement by a pair of ball bushings 765 and 766 mounted at spaced locations for sliding along a horizontally extending first guide rod 767 mounted in opposite ends to spaced stationary frame blocks 769 and 770. The slide also includes a cross bar 771 which extends horizontally across to another parallel guide bar 773 which is mounted in a pair of stationary vertical frame members 775 and 777. The cross bar 771 carries another ball bushing 778 to slide along the guide bar 773 as the slide is shifted to move the shuttle to transfer the cups from the conveyor 12 to the take-off conveyor 606.

A drive mechanism 779 for reciprocating the slide 749 includes a horizontally extending connecting rod 780 having one end pivotally attached by a pin 781 to the center of the slide cross bar 771. The opposite end of the connecting rod is connected by a pivot pin 783 to a crank arm 785. The crank arm 785 is secured to an upper end of vertically extending 787 of a right angle gear unit 789 which, in turn, is driven by an input gear 919H meshed with a drive gear 793 of the main drive, which will be explained hereinafter. The right angle gear unit 789 is supported on a suitable bracket 794 fastened to horizontally extending end frame member 795. Thus it will be seen that as the right angle gear unit 789 turns the crank 785, the connecting rod 780 reciprocates the slide 749 and the shuttle 603, first in a forward direction and then in a reverse direction to be positioned rearwardly of the cups being raised by the elevator mechanism. The cups will be raised to the height of the dead plate when the shuttle 603 moves into abutting engagement therewith to force the lifted cups forwardly across the leading edge of the dead plate 605 and onto the takeup conveyor 606.

Figure 33:
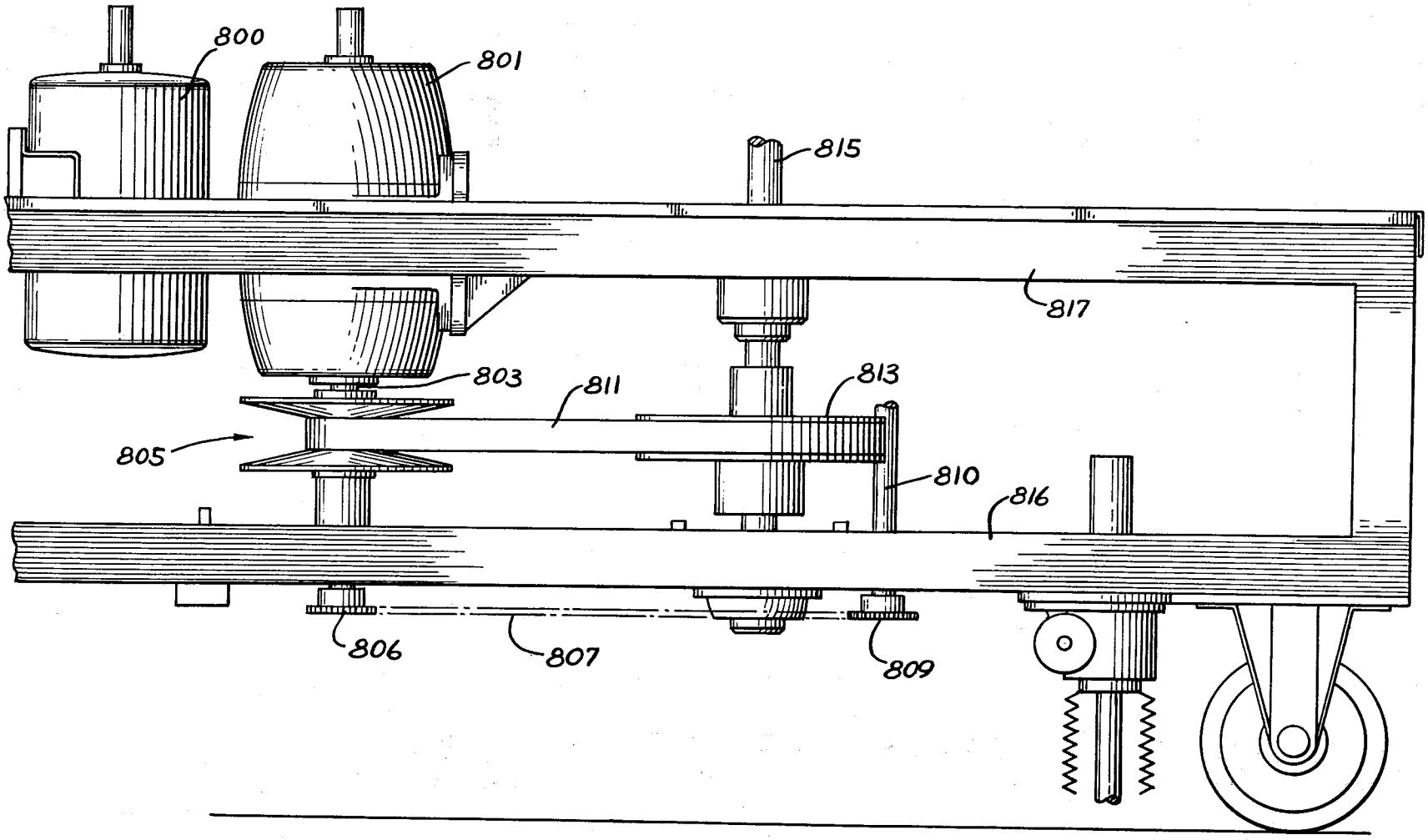
FIG. 33 is an elevational view of a lower drive motor unit for the apparatus of FIG. 1.

Within the stationary main frame extending longitudinally along the conveyor 12 is a main drive power unit and gear box for driving in timed relationship each of the various mechanisms at the various stations described above. More specifically, the power for driving the mechanisms originates with a pair of electrical motors 800 and 801 as best seen in FIG. 33. The motor 801 has an output shaft 803 which drives a variable pitch sheave 805, the pitch diameter of which may be adjusted to vary the speed of the motor drive. The variable pitch sheave 805 is a commercially available one and may take several forms, the illustrated one includes a drive therefor including a sprocket 806 driven by chain 807 leading to another sprocket 809 in turn driven by a shaft 810 at a convenient location for the operator. The output drive from the variable pitch sheave 805 is through a belt 811 extending to a sheave 813 fixed to a vertically mounted shaft 815 which extends and is journaled between upper and lower plates 816 and 817.

Figure 34:
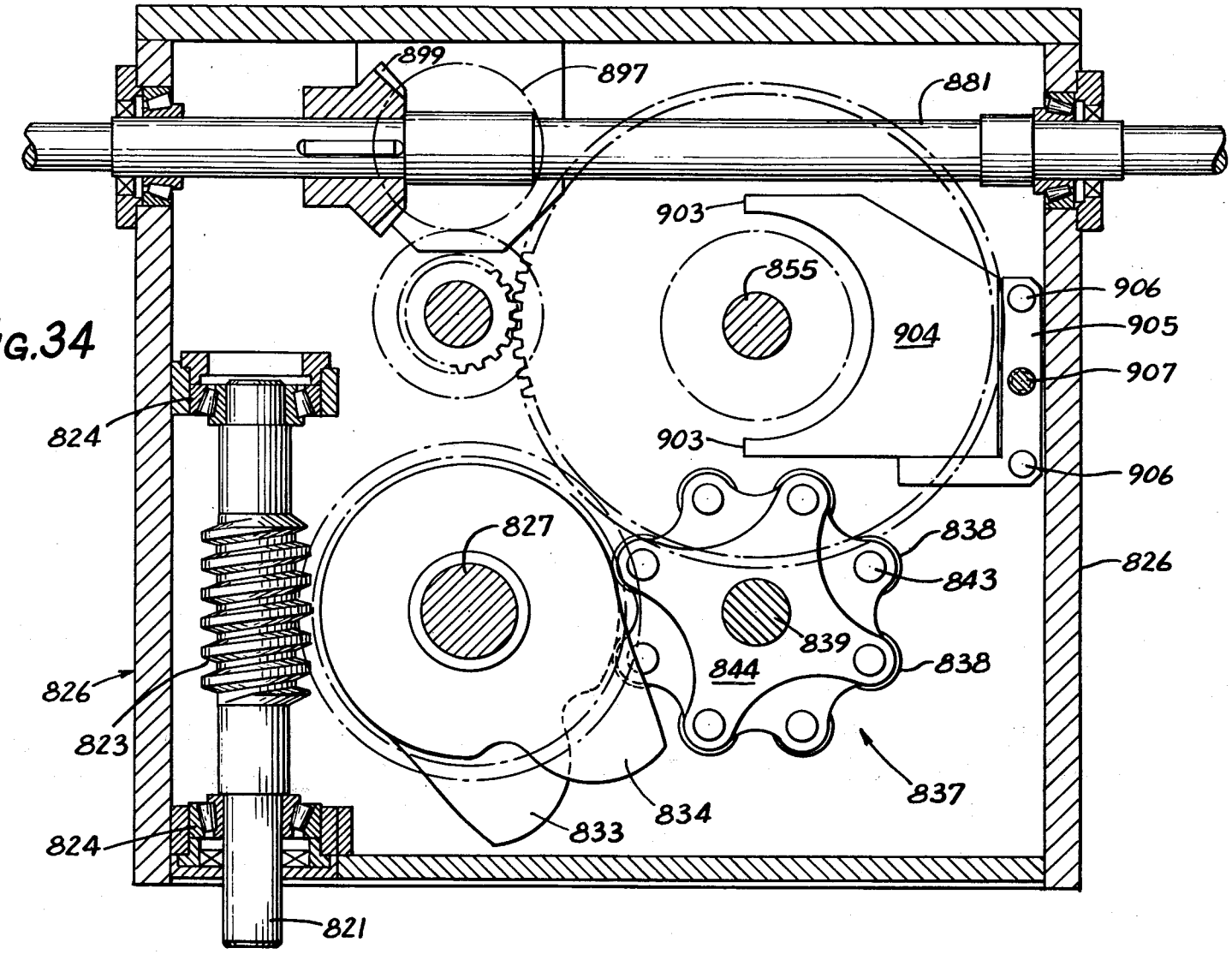
FIG. 34 is a vertical sectional view of a gear box driven by the power unit shown in FIG. 33.

The lower power unit drives the upper power unit by means of the vertically extending shaft 815 which is coupled to the lower end of a vertical extending input shaft 821, FIG. 34, to a gear box or upper power unit. The input shaft 821 carries a worm gear 823 and is journaled for rotation about a vertical axis in bearings 824 carried by a stationary gear box 826. The worm gear 823 is in meshed engagement with a gear 825, FIG. 35, which has an inner hub fixed to a horizontally extending shaft 827 extending between stationary frame walls 829 and 831 of the gear box 826. The worm gears 823 and 825 provide a 20 to 1 speed reduction in this instance.

Figure 35:
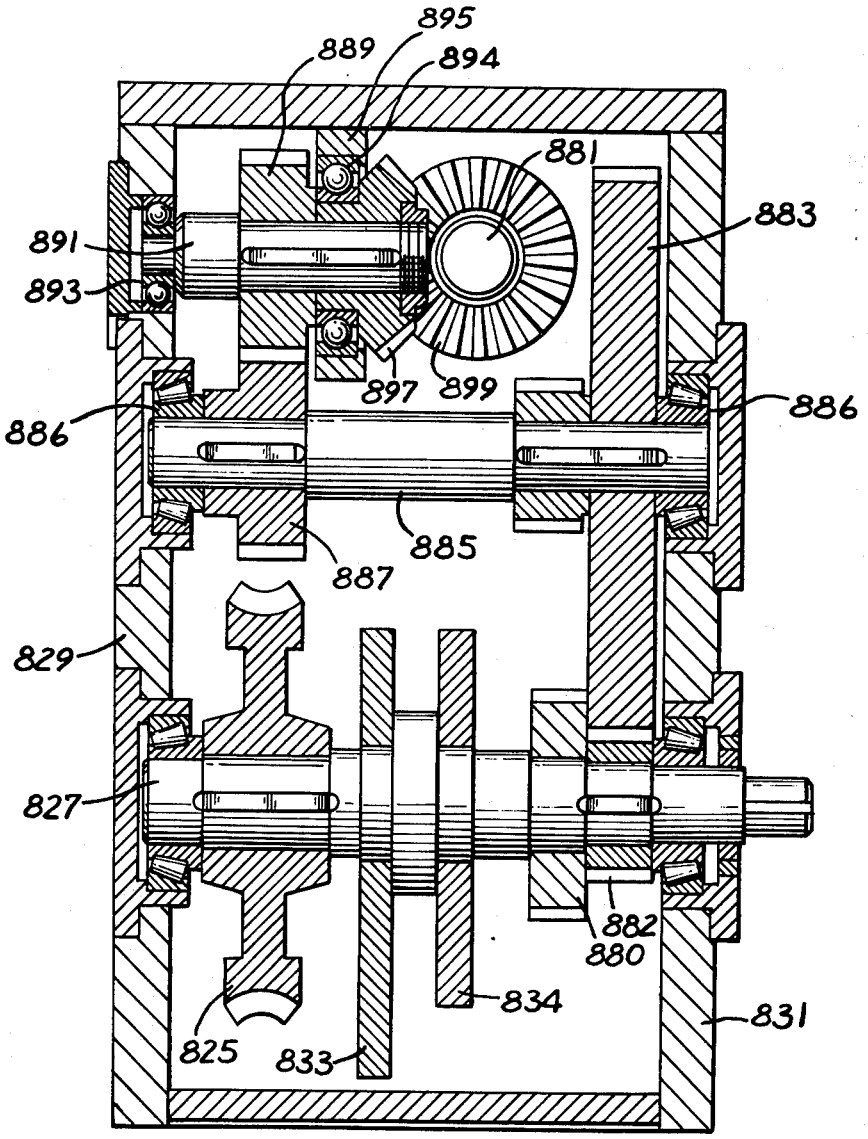
FIG. 35 is another vertical sectional view of the gear box shown in FIG. 34.
Figure 36:
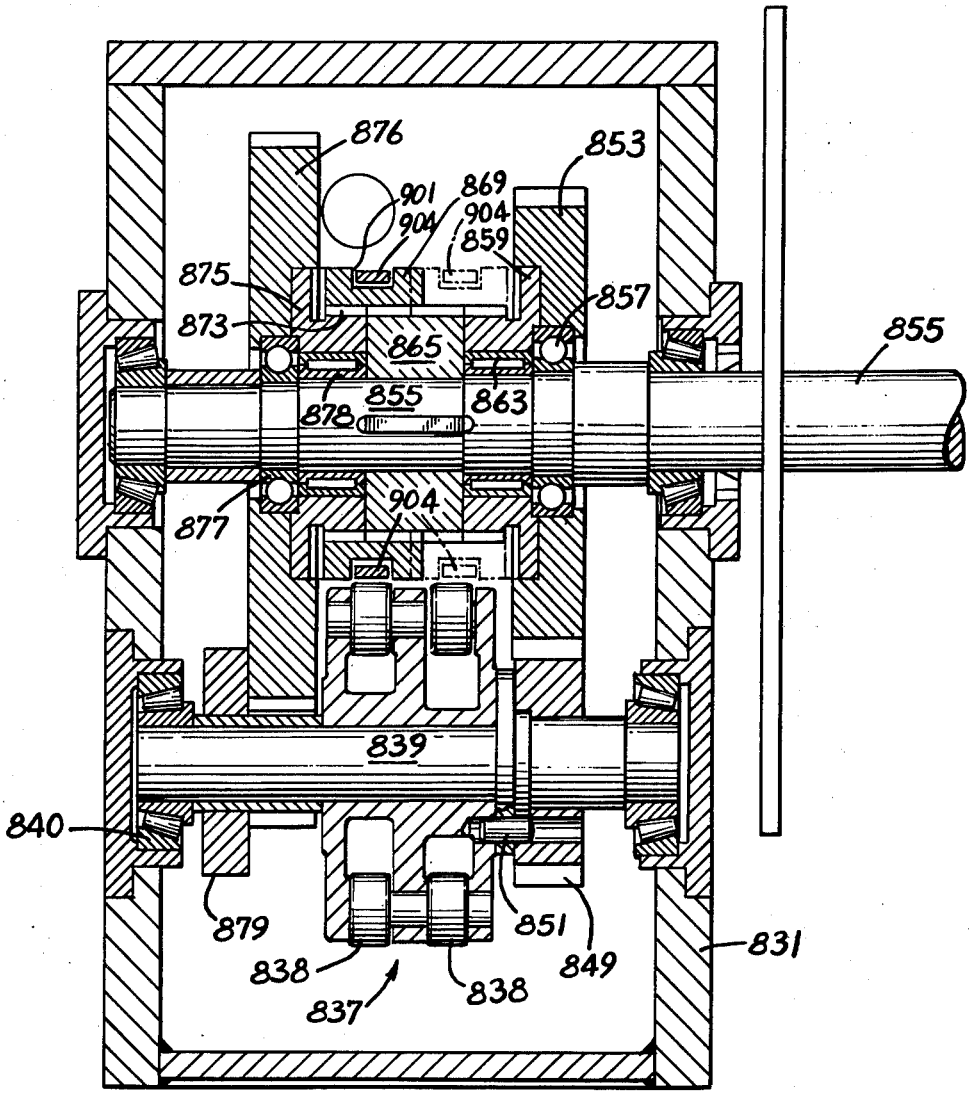
FIG. 36 is a sectional view of the gear box shown in FIG. 34.

The preferred constructions provide for the selective employment of either a continuous motion drive for the conveyor 12, or alternatively, an intermittent drive may be selected. The manner of providing an intermittent drive is through a 4 to 1 stop index mechanism, shown in FIGS. 34 and 35, which includes a pair of cams 833 and 835 mounted on the shaft 827 which, as seen in FIG. 35, is driven by the input from worm gears 823 and 825. The lobes of the cams 833 and 835 are used to drive a roller Geneva mechanism 837, FIG. 35, which includes eight rollers 838 mounted at equally spaced positions about a central index shaft 839. More specifically, as best seen in FIG. 36, the index Geneva wheel 837 for indexing comprises a pair of rollers 838 mounted on horizontal axles 843 in an index Geneva wheel 844 for engagement by the respective lobes of the cams 833 and 834 to index the shaft 839 which is mounted for turning movement in bearings 840 mounted on stationary walls 829 and 831. The Geneva wheel 844 is secured to the shaft 839 to turn therewith. Pinned to the output side of the Geneva index mechanism 837 is a gear 849 connected by pins 851 to the index wheel 844 to turn another gear 853 and thereby provide a 2 to 1 gear reduction for an output shaft 855 which extends through the wall 831 to the center sprocket of the conveyor 12 to turn the same. More specifically, the gear 853 is mounted for free rotation by a bearing 857 about the shaft 855. Another coaxial, adjacent gear 859 is attached to the gear 853 and it is mounted to turn about the shaft 855 by a roller bearing 863 carried by the shaft 855. A central gear 865 is keyed to the shaft 855 to turn the same either intermittently or continuously, as will be explained.

As the indexing mechanism 837 intermittently turns the gear 849, the latter turns the gears 853 and 859 about the shaft 855 and if a clutch member in the form of a gear 869 is in the proper position, as shown by dotted lines in FIG. 36, the gear 859 is connected thereby to the drive gear 865 to turn the shaft 855 and the conveyor 12 in an intermittent manner. The clutch gear 869 has internal gear teeth which mesh with the gear teeth on the drive gear 865 in each of its two positions, as shown in solid and dotted lines in FIG. 36. When the clutch gear 869 is in the solid line position shown in FIG. 36, its teeth are meshed with teeth 873 of a gear 875 fastened to a larger gear 876 which is freely rotatable on ball bearing 877 on the output shaft 855. The gear 875 is likewise mounted for free rotation on the shaft 855 by a bearing 878. As will be described, a gear 879 freely rotatable on the shaft 839 drives the gear 876 continuously and thereby, when the clutch gear 869 is in the solid line position of FIG. 36, drives the gears 875 and 865 and the conveyor drive shaft 855 to drive the conveyor 12 without interruption.

Referring now in more detail to the input for continuous motion drive of the shaft 855, it will be recalled that the worm gear 823, FIG. 34, on the input shaft 821 continuously rotates its support shaft 827. Fixed to the shaft 827 is a gear 880 which drives the gear 879 (FIG. 36) to provide a continuous drive input to the large drive gear 876 and the conveyor drive shaft 855 when the clutch gear 869 connects these gears as seen in FIG. 36.

As discussed above in reference to the various operating stations, they each receive a drive from the power take-off shaft 881 which extends longitudinally and parallel to the conveyor 12. Herein, the drive for the drive shaft 881 is from a gear 882, FIG. 35, fixed to the continuously rotating shaft 827 and meshed with a large gear 883 keyed to a shaft 885 which is journaled in bearings 886 in the frame side walls 829 and 831 to be parallel to the shaft 827. The shaft 885 has secured thereto a gear 887 which drives a gear 889 keyed to a short shaft 891 journaled in a first bearing 893 in the frame wall 829 and in a second bearing 894 carried by a stationary depending bracket 895. Fixed to one end of the short shaft 891 is a beveled gear 897 which is meshed with a beveled gear 899 fixed to the proper take-off shaft 881 to drive the same.

To shift between intermittent and continuous drive, the clutch gear 869, FIG. 36, is provided with an outer annular groove 901, FIG. 36, into which projects ends 903 (FIG. 34) of a shifting yoke 904. The shifting yoke 904 is mounted for sliding reciprocal movement by a carrier 905 mounted on a pair of horizontally extending guide rods 906 mounted on the gear box 826. A threaded shaft 907 is threaded in a nut in the carrier 905 and with turning of the threaded shaft 907 the carrier and yoke 904 are moved longitudinally relative to the output shaft 855 to shift the clutch gear 869 into engagement with either the continuously rotating gear 876 or the intermittently turning gear 859. A handle (not shown) is connected to the threaded shaft 907 at a location exterior of the gear box 826 to allow the operator to turn the shaft 907 and shift readily between continuous and intermittent drives.

Figure 37:
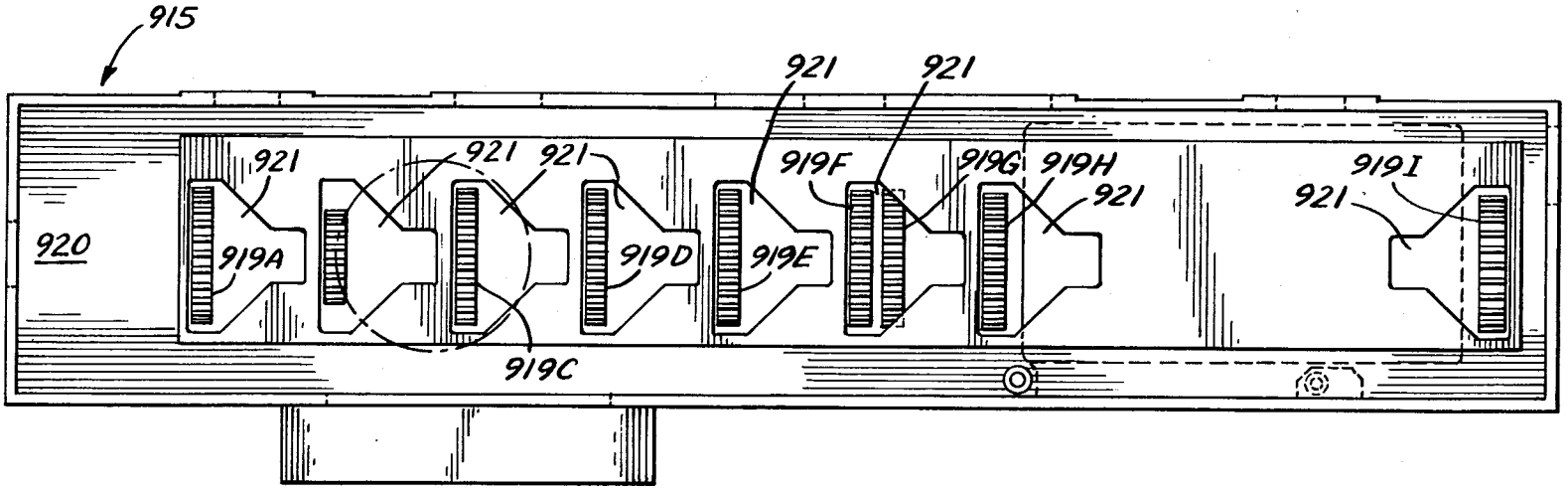
FIG. 37 is a plan view of the machine frame having the power take-off shaft extending longitudinally therein.
Figure 38:
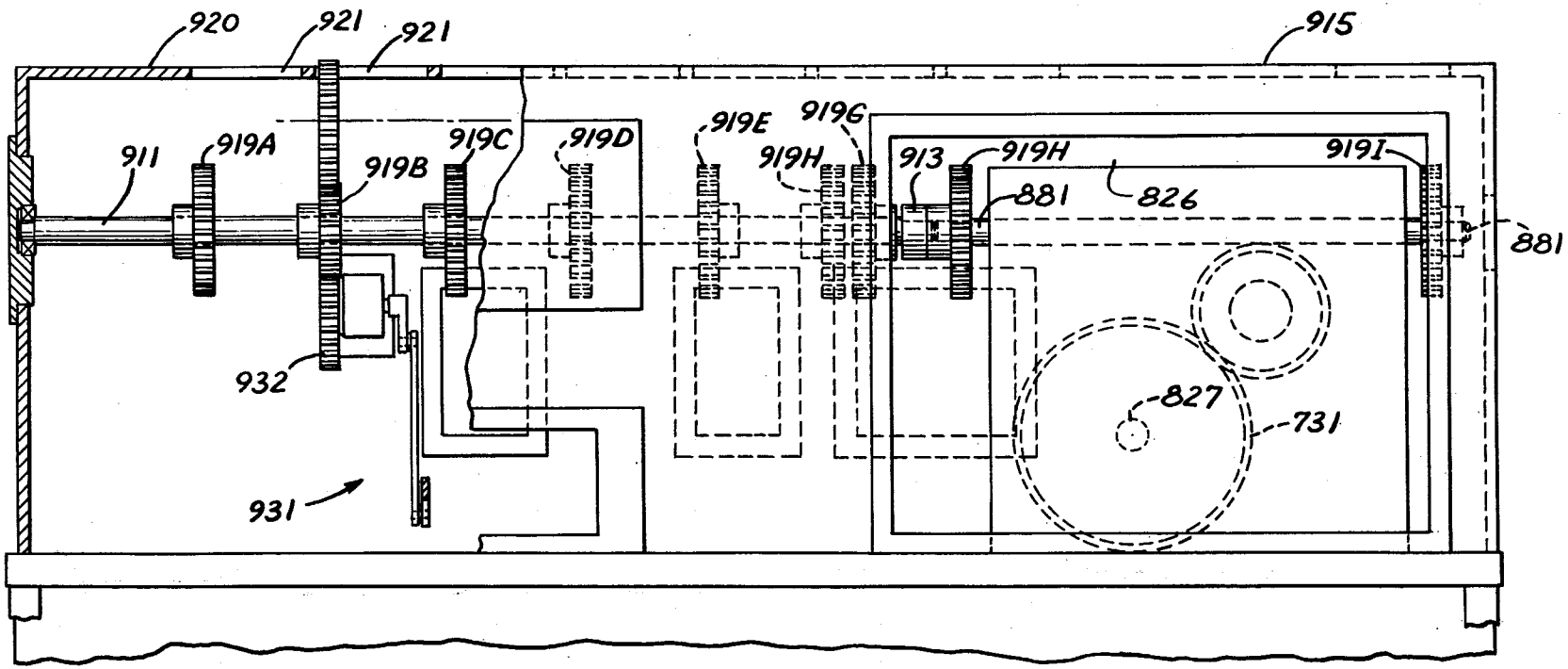
FIG. 38 is a front elevational view of FIG. 37.
Figure 39:
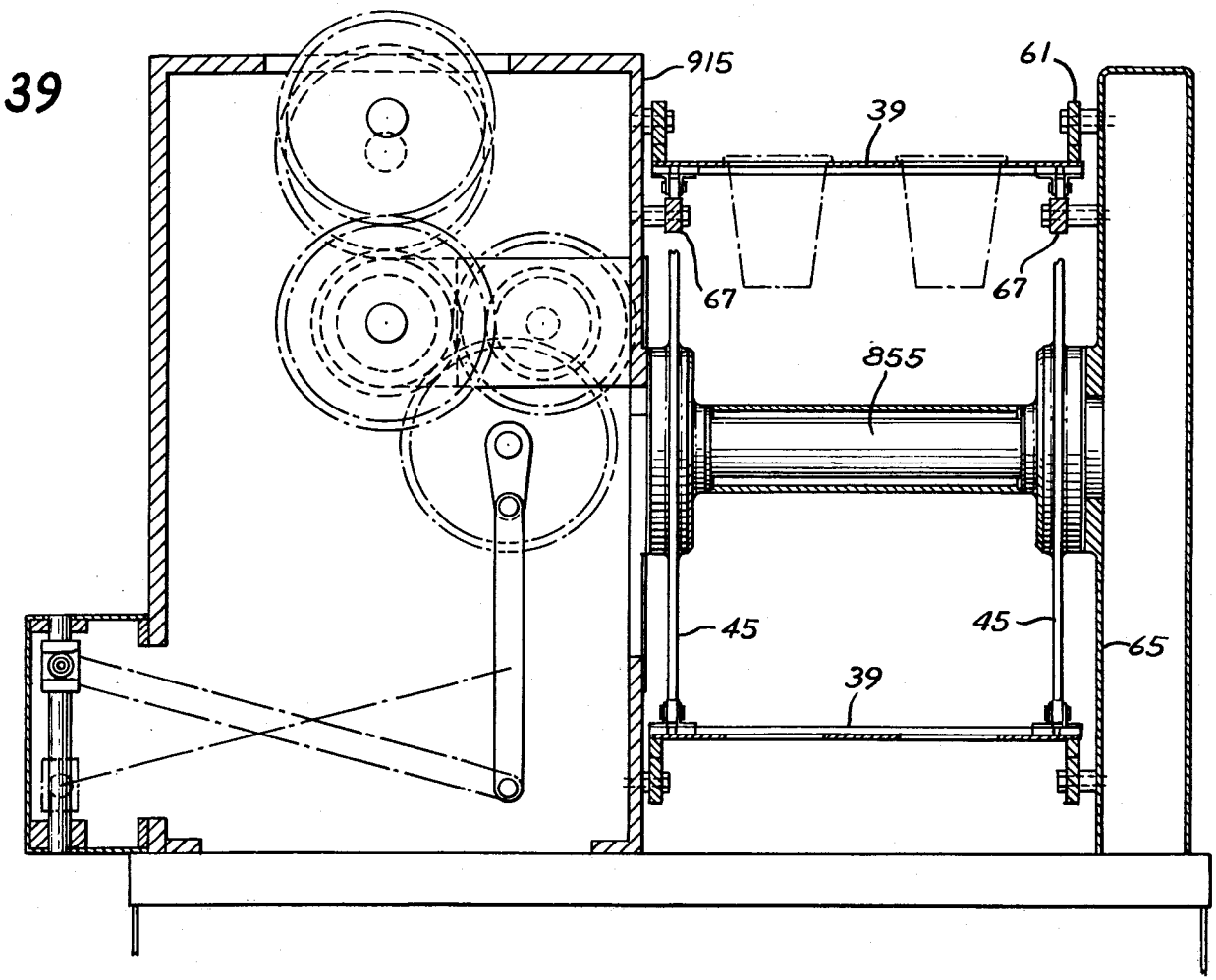
FIG. 39 is an end view of the frame shown in FIG. 37.

As best seen in FIGS. 37, 38 and 39, the power take-off shaft 881 extends longitudinally through the gear box 826 and is coupled to an elongated power take-off shaft 911 by a coupling 913. The combined shafts 881 and 911 extend the length of the machine frame 915. For each of the respective operating stations there is provided one or more input drive gears 919A, 919B, — 919I attached to the shafts 911 or 881 for driving all of the stations in a correlated manner. Several of these gears may be of different sizes depending upon the speed desired for the input for the various mechanisms driven thereby. A top plate 920 of the machine frame 915 is provided with a series of openings 921 therein by which the various gears from above-described stations project downwardly into engagement with one of the respective 919A — 919G to be driven thereby. As best seen in FIG. 38, the elevator cam 731 is attached to the end of the continuously rotating shaft 827 in the gear box 826 to shift the elevator mechanism in timed relationship to the other operations.

Figure 40:
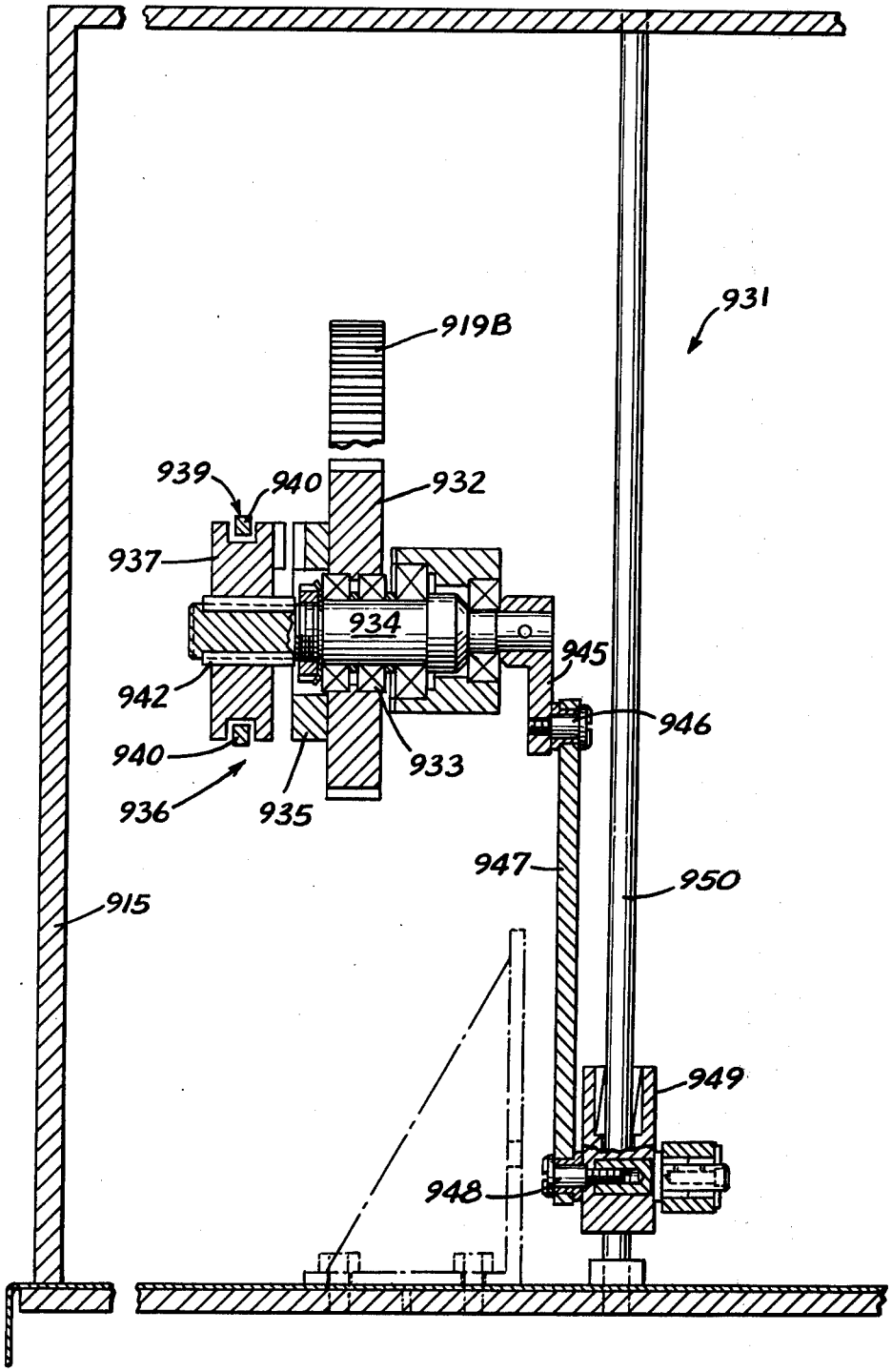
FIG. 40 is a vertical section view of the liquid filling drive mechanism.
Figure 41:
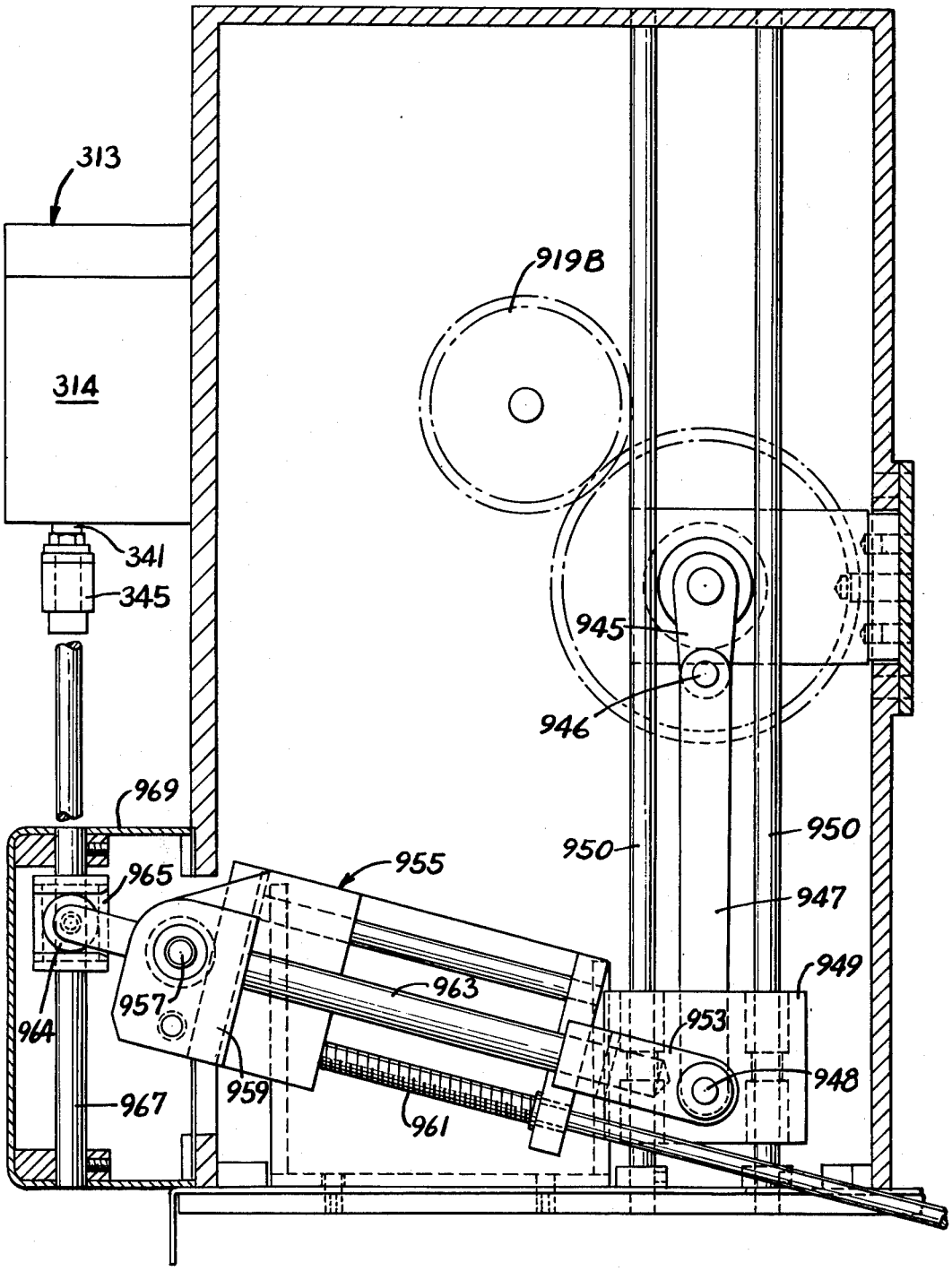
FIG. 41 is a side view of the liquid filled drive mechanism shown in FIG. 40.

The drive gear 919B on the shaft 911 powers a liquid fill drive 931, shown in FIGS. 40 and 41, for operating the pumps to deliver metered charges to the cups at the cup filling station. The drive from the gear 919B is to a gear 932, as best seen in FIG. 40, journaled for free rotation by bearings 933 about a shaft 934 suitably supported in the machine frame 915. Affixed to the gear 932 is an input gear 935 of a clutch unit 936 which includes an output gear 937 keyed to the shaft 934 to rotate the same when the facing gears 935 and 937 are engaged. When the gears 935 and 936 are spaced, as shown in FIG. 40, the gears 932 and 935 turn freely about the non-turning shaft 934.

To selectively couple or uncouple the fill drive clutch unit 936, a yoke 939 is provided with fork tines 940 in an annular groove 941 in the gear 937. A handle mechanism (not shown) is provided to shift yoke 939 longitudinally of the shaft 934 to engage or disengage the clutch 936. The keys or slides 942 fixed on the shaft 944 key the gear 937 to the shaft 934 and allow the same to move longitudinally along the shaft between clutch-engaged and clutch-disengaged positions.

Fastened to the opposite end of the shaft 934 is a crank 945 (FIG. 40) which is connected by a pin 946 to a crank arm 947 which is connected by a pin 948 to one side of a slide block 949 guided for vertical movement by a pair of vertically extending guide rods 950 attached to the top and bottom plates of the machine frame 915. The guide block 949 carries a pin 951 on its other side coaxially located with the pin 948 and connected to a clevis arm 953 to a variable fulcrum device 955 which is similar to the variable fulcrum device 607 (FIG. 28) used to operate the elevator mechanism. The variable fulcrum device 955 includes a movable fulcrum pin 957 carried on a slide 959 movable with turning of a threaded shaft or screw 961 connected thereto. The shaft 961 is connected to handle operated turning mechanism located at a convenient location at which the operator may finely adjust the output arc of fulcrum lever 963 and thereby the stroke or pistons in the metering pumps.

A brief description of the operation of the above-described apparatus will be given as a means to understand the invention. The illustrated conveyor 12 extends the full length of the apparatus and is comprised of a pair of spaced chains 43 carrying a series of cup supports 39 along a horizontally extending upper run from a cup dispensing station 17, through a filling station 19, a capping station 21, and to discharge station 23 at which the cups are lifted by the elevating and discharge means 35. The conveyor chains 43 are driven by sprockets 47 connected to the conveyor drive shaft 855. Should an intermittent movement of the conveyor be desired, a clutch gear 869 may be shifted from a continuous position, which is shown in solid lines in FIG. 36, in which the conveyor drive shaft 855 is continuously rotating, to the intermittent position, shown in dashed lines in FIG. 36, the conveyor shaft 855 may be clutched to and driven intermittently by index mechanism 837.

At the cup dispensing station 17, a cup dispensing means 83, as best seen in FIGS. 5–7, is provided for dispensing a pair of cups 14 simultaneously from stacks of cups into a pair of openings 14 in the cup supports 39 passing therebeneath. To assure that the cups are positively stripped and forced into the openings, a stripper means 87 including disk-shaped cup strippers 98 having cup-engaging grooves 101 therein are disposed at the lower ends of the cup dispensing gears 83 which rotate to lower the cups in a well-known manner. The cup strippers 98 include the upstanding vertically reciprocating rods 99 fastened at their upper ends to a vertically reciprocable guide plate 196A, FIG. 9, which is shifted vertically by a barrel cam 193 in timed relationship to turning of the cup-dispensing spiral gears 83.

Herein, the cup dispensing gears are rotated by a drive including a common drive chain 113 to turn the same to cause the spiral grooves 97 therein to carry the cup rims 31 downwardly to the position at which the stripper means 98 force the cups downwardly into the openings 15 in the conveyor cup supports 39. The height of the dispensing frame means 95, which carries the stacks of cups, dispensing gears and cup stripper means, may be raised and lowered to allow for the different sizes of cups which may be dispensed. Lock nuts 189, FIG. 8, are tightened to hold the cup dispensing frame 95 at the desired height above the conveyor 12 for the cups being dispensed. The drive for the cup dispensing means is from a gear 181 which is meshed with gear 919A mounted on the longitudinally extending take-off shaft 911 which extends longitudinally in the stationary machine frame 915 adjacent the conveyor 12.

The cups are carried forwardly by the conveyor 12 to the filling station 19 at which a plurality of cups, namely six cups in this instance, are filled simultaneously with material discharged through nozzles 200 into the underlying open cups. In this instance, there are six nozzles 200 over three cups in each of the two rows carried by the conveyor with the cups being placed in a movable carriage 201 which is reciprocal longitudinally with the cups in the forward direction at the same speed the cups travel by means including a barrel cam 300. With the cam follower 301 extending to the nozzle supporting carriage 201 which is guided for rectilinear movement along guide rods 205 and 311 as best seen in FIG. 12.

Each of the six filling nozzles 200 in the carriage 201 is connected by flexible hoses 239 to the metering pump means including metering pumps 313, FIG. 16. The filling nozzles 200 each include a shut-off valve 223 having a vertical movable valve plunger 247, FIG. 10, having a lower tip 245 for shifting to and from abutting engagement with a valve seat wall 241 to open and close the discharge orifice 243 through which the liquid filling material flows to the underlying cups. The valve plungers 247 are biased to a closed position by springs encircling rods 249 connected to the plungers 247. The valve plungers are shifted between the open and closed positions by a toggle mechanism 225 which simultaneously opens (and closes) the six shut-off valves 223 for the respective nozzles 200. In this instance, when the carriage shifts to the forward position a stop 227 operates the toggle mechanism 225 to cause a toggle bar 263 to raise and lift the rods 249 against the force of the springs to space the valve tips 245 above the valve seat walls 241 leaving the discharge orifices 243, as seen in the left-hand portion of FIG. 10. In this position, the toggle-like mechanism has a pair of links 267 and 269 disposed in vertical alignment.

When the carriage reaches the other end of its travel, another rearward stop 229 operates means to pivot the toggle mechanism with the links 267 and 269 being in a bent and knuckle-like position allowing the common actuating bar 263 and springs to close the valves and prevent dripping therefrom during reversal of the carriage which may be at a faster speed than the forward speed of the carriage. As the filling nozzles 200 travel forwardly for a considerable period before reversing, sufficient time is provided to fill the cups without splashing of the liquid from the cups as may be the case if a high discharge rate of filling material was attempted by filling from stationary nozzles.

The filling nozzles 200 are connected by the flexible hoses 239 to metering pumps 313, as best seen in FIGS. 15, 16 and 17, having pistons 337 which are controlled precisely in their strokes in cylinders 331 to provide a metered amount of filling material for discharge therefrom into the flexible hoses for each filling operation. Herein, the metering pumps 313 each comprise a pair of cylinders 331 having therein a pair of metering pistons 337 which are vertically reciprocal by rods 341 connected to a common actuating bar 345. During the downward movement of the pistons 337, the comestible liquid is drawn inwardly through an inlet fitting 315 and through the orifice at valve seat 320 and the sector shaped openings 334 into the cylinders 331. During this period, outlet check balls 351 are seated in the closed position. When the nozzles 200 have been returned and are in the open position with the filling carriage 301 traveling forwardly, the pistons 337 are raised upwardly in the cylinders 331 causing the inlet check valve 317 to close and the outlet check valves 347 to open to allow the metered amount of comestible filling material to flow through the hoses 239 to the nozzles 200.

Each of the three pumps 313, therefore, comprises a pair of cylinders 331 for feeding a pair of nozzles 200 for filling the six cups simultaneously. The three pumps are driven simultaneously by the horizontally extending common operating bar 345 which is driven by a liquid fill drive unit 931, as best seen in FIGS. 40 and 41. The latter is driven by a gear 919B of the power take-off shaft 911 and includes a clutch 936 which may be disengaged to prevent a filling operation when the machine is being operated for maintenance or the like without a filling operation. With the clutch 936 engaged, a crank 945 drives a connecting rod 947 extending to a slide block 949 guided for sliding on guide rods 950 and connected to a variable fulcrum device 955. The variable fulcrum device 955 may be manually operated by means including a shaft 961 to shift its fulcrum point at fulcrum pin 957 to change the movement or stroke os the output fulcrum lever 963 which operates a vertically movable block having upstanding rods connected at their upper ends to the common operating bar 345 to which are fastened the lower ends of the piston rods 341. Thus, by operating the variable fulcrum device, even while the metered pump is operating the fulcrum point can be shifted and one can change the amount of liquid discharge to the individual cups to make sure they are filled properly. Also, one may adjust the metering mechanism for the different sizes of cups which may be filled with the present invention.

The newly filled cups are carried forward by the conveyor 12 to the covering station at which covers 29 are heat sealed to the rims 31 of the cups by heat sealing heads 403. In this instance, the heat sealing heads 403 are heated and pressed downwardly against the top of the cover material to provide the heat and pressure between the cover material and the cup rims while being carried forward by their carrier 415 and at the speed of travel of the cups and conveyor 12. The heat seal heads 403 are mounted on the lower ends of vertical shafts 411 projecting upwardly through bushings 413 in the horizontally movable carrier 415 to a cross member 428 carrying a cam block 427. One end of an operating lever 417 carries a cam roller 423 which vertically reciprocates the cam block 427, rods 411, and heat sealing heads 403 while carrier 415 moves horizontally. As best seen in FIG. 20, the heat sealing carrier 415 is mounted for sliding movement along horizontally extending slide rods **431*a*, and has a cam follower 442 thereon which is shifted by a barrel cam 437 superimposed over the carrier 415** to reciprocate the latter.

The illustrated covers 29 are a laminate comprising an inner heat sealable plastic layer, an intermediate foil layer and an outer paper layer. The covers 29 are formed from a web 457 of cover material rolled into a large supply roll 450 carried on a reel 460, as best seen in FIGS. 21 and 22. The web is stripped from the roll and travels to the paper guide 453 and therefrom to a serrating mechanism 455 comprising the anvil roller 483 and a serrating roller 485. The rollers also serve to feed the cover material 457 and to strip the same from the supply roll 450. A serrating bar on the serrating rollers 485 forms serrations transversely of the web 457 during each revolution of the serrating roller 485. From the nip of the rollers 483 and 485, the leading edge of the webs engages the rims of the filled cups passing therebelow. Then, the heat seal heads are shifted down to clamp the webs against the cup rims and apply heat to seal to the cover web and the heat seal heads travel forwardly at the speed of the conveyor which is about three times the web feed spaced and hence the web is tensioned and breaks along the serrated line to form the individual and detached covers for each pair of cups.

The cups which are now filled and hermetically sealed by covers 29 are ready to be discharged at discharge station 23 by an elevator mechanism 601 which lifts the cups upwardly to the top of the cup supports 39 for shifting across the stationary or dead plate 605 to a take-off conveyor 606. The illustrated elevator mechanism 601 comprises vertical movable elevator pads 611, as best seen in FIG. 23, which are spaced below the bottoms of the cups moving into the discharge station 23. The elevator pads 611 are guided upwardly for vertical movement by a vertically slidable block 617 connected thereto. The block 617 is constrained for vertical movement along a pair of vertical posts 619. When the cups are being continuously moved forward by the conveyor 12, the pair of elevator pads 611 also move horizontally at the same speed of the cups while elevating the same.

Herein the elevator pads 611 are moved horizontally by an attached carrier 621 which is connected to a push-pull rod 651 which reciprocates the carrier block 621. The carrier block 621 is guided for horizontal rectilinear movement by a pair of fixed stationary guide rods 645 and 646. The downstream end of the push-pull rod 651 is connected to a block 657, as best seen in FIG. 26, also constrained for rectilinear movement along the stationary guide rods 645 and 646. The block 657 carries a cam follower 659 projecting into a groove and a barrel cam 669 which is rotated by a gear train extending to one of the gears 919A-919I on the power take-off shaft 911. Thus, as the gears rotate the barrel cam 669, the push-pull rod 651 is reciprocated to slide the carrier block 621 along the guide rods 641 and 646 to shift horizontally the carrier 621 and the elevator pads 611 while the latter are also being moved vertically.

The elevator pads 611 are moved vertically by an actuating lever 623 having a cam follower 625 projecting into a cam slot 629, FIG. 25, and the slid block 617 carrying the elevator pads. The actuating lever 623 is connected by a rock shaft to a lever 637 which has one end connected to a movable fulcrum device 607, FIG. 28. The movable fulcrum device may be adjusted manually by the operator to change the fulcrum point of the fulcrum lever 623 so as to control the amount of stroke of the fulcrum lever which operates the elevator pads 611. The movable fulcrum device 607 maintains a constant upper position for the pads at the level of the conveyor plates. The fulcrum lever 623 is connected to the lever 637 to turn the rock shaft 631 and the actuating lever 623 to cause the slide block 617 and the elevator pads 611 to move in a vertical direction.

By turning a crank handle (not shown) attached to shaft 715, FIG. 28, attached to a cleavis for turning the screw shaft 709 of the movable fulcrum device 607, the position of the movable fulcrum pin 699 may be adjusted relative the end frame plates 705 to change its location and thereby the location of the fulcrum point and the arc of the fulcrum lever 693. The drive for the fulcrum lever 693 is from a pin 697 carried at one end thereof which extends at right angles to the fulcrum lever 693 and into a hole in the translating slide. The translating slide is constrained to travel along upstanding vertical guide rods 719 and 720, as best seen in FIGS. 29 and 30 and this slide is reciprocated vertically by an elevator cam 731 carried on a shaft 827, as best seen in FIG. 29, the shaft 827 being driven from the gear box 826, as shown in FIGS. 34 and 35, and described hereinbefore.

Figure 32:
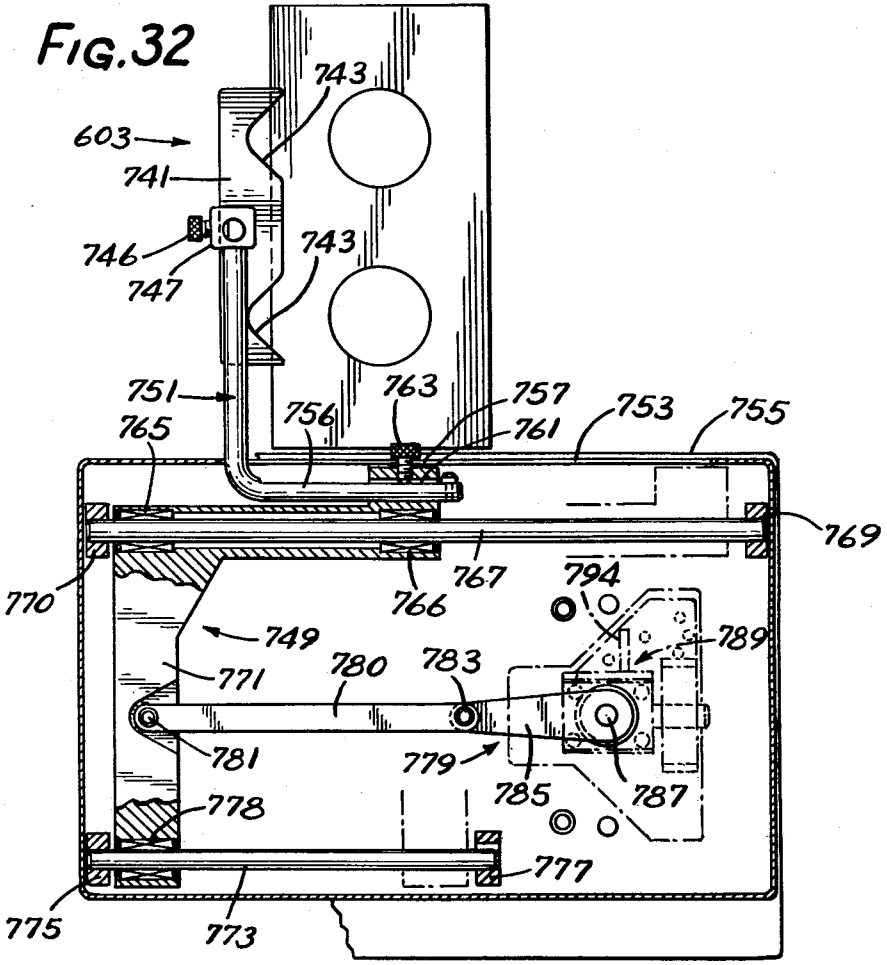
FIG. 32 is a partially sectional view of a cup transfer slide and actuating mechanism therefor.
Figure 31:
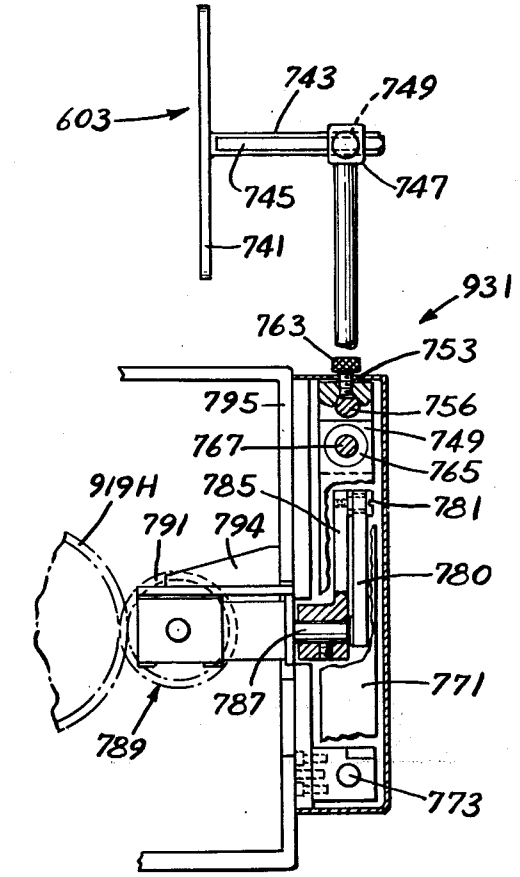
FIG. 31 is a partially sectional view of a cup transfer mechanism.

After the cups have been raised to the height of the conveyor plates, as best shown in FIG. 1, the sweeper pusher 603 pushes the cups across the stationary discharge plate 605 to the takeup conveyor 606. As best seen in FIGS. 31 and 32, the shuttle 603 is moved rectilinearly and in timed relationship to the speed of the conveyor 12 by a slide 749 which is guided for horizontal movement along a pair of guide rods 767 and 773. The slide 749 is driven by a drive mechanism 779 which includes a horizontally extending connecting rod 780 connected to a drive crank 785 fastened to the upper ends of the shaft 787 of a right angle gear unit 789 driven by a gear 791 meshed with a drive gear 919H. The drive gear 919H is mounted on the drive shaft 881 and is driven through the gear box 826. Thus, on each forward stroke of the shuttle, the cups raised by the elevator pads 611 are pushed forwardly with the bottoms of the cups sliding across the dead plate 605 and onto the top of take-off conveyor belt. During the return stroke of the shuttle 603, the elevator pads 611 will have been lowered and will have begun to raise the next set of cups so that after the end of the shuttle return stroke this next set of cups is ready for removal on the succeeding forward stroke of the shuttle.

While the preferred operation has the conveyor 12 continuously moving with the cups continuously moving without stopping through each of the stations, means are provided for converting to intermittent or stepping operation for the conveyor 12. Additionally, the various devices at the various dispensing, filling and capping stations may be rendered immobile, i.e., from translating with cups, as occurs when the conveyor is continuously moving. More specifically, to shift to an intermittent conveyor operation, the operator will turn a crank handle (not shown) which is connected to the shaft 907, shown in FIG. 34, to turn it to cause the yoke 904 to slide on rods 906 and to be shifted between the solid and dotted line positions shown in FIG. 36. As the yoke 904 shifts, it moves the clutch gear 869 between engagement with the gear 859 for intermittent operation of the shaft 855 through the indexing mechanism 837 or to the solid line position shown in FIG. 36 in which the gear 876 is being continuously driven by the gear 879 which is then clutched to the shaft 855. The index mechanism 837 provides the stepping movement of the shaft 855 which extends to and has mounted thereon on the conveyor drive sprockets 45, as best seen in FIG. 39. Also, for intermittent operation, the lock plate 650, FIG. 25, is placed in the position shown in FIG. 25 to allow the drive shaft 651 to slide freely through the bore in the block 641. Thus, the elevator pads 611 will merely rise and fall without translating horizontally. Also, the translating drive from the barrel cam 437 for the heat seal heads 403 is disabled so that the heat seat heads 403 also move only vertically. Thus, it will be seen that the apparatus may be used in an intermittent operation with suitable simple adjustments thereto.

From the foregoing it will be seen that the present invention comprises an apparatus which may be readily adapted for use with various sizes of cups and it can be used to fill the cups while they are continuously being moved by the conveyor 12 to the cup dispensing, cup filling, cup capping and cup discharge stations. Variable fulcrum devices for the elevator mechanism to lift the cups from the conveyor and for the controlling of the filling charge may be actuated while the machine is operating to provide fine adjustments to assure proper filling and proper height of lift or to provide large adjustments as is necessary for changing between different sizes of cups. Additionally, by operation of the clutch mechanism and other suitable adjustments, the traveling motion of the cups may be changed between intermittent and continuous movement.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. In an apparatus for positively dispensing cups each having a rim and an upper end thereon, the combination comprising means for receiving a vertical stack of nested cups for discharge from an opening in said means, a plurality of dispensing gears disposed about said opening and each having spiral grooves therein for receiving the rims of the cups to lower the cup rims with turning of said dispensing gears, said dispensing gears having lower ends thereon, means for rotating said dispensing gears to successively lower a cup rim, cup stripper means at the lower ends of said cup dispensing gears and rotatable therewith to strip cups from the stack and having portions thereof for engaging said cup rims leaving said spiral grooves, said cup stripper means including means for reciprocating said portions engaging said cup rims relative to said dispensing gears and for forcing said cups downwardly with downward movement of said cup stripping means, said portions of said cup stripping means each having a groove therein aligned with a spiral groove in an associated dispensing gear to receive the cup rim, and means maintaining said alignment of said grooves on said portions and said gears during the rotation thereof and during reciprocation of one relative to the other.

2. An apparatus in accordance with claim 1, in which said portions of said cup stripping means are in the shape of discs, said means for reciprocating each of said disks comprises a vertical extending shaft coaxial with an associated one of said dispensing gears.

3. An apparatus in accordance with claim 2 in which a pin extends between each of said cup stripping disks and an associated dispensing gear and in which each of said shafts is rotated to turn its disk and to turn said pin therewith and to thereby turn its associated dispensing gear.

4. In an apparatus for positively dispensing cups each having a rim at an upper end thereof from a nested stack of cups, the combination comprising a cup support means for supporting a stack of nested cups and having a discharge opening through which said cups pass to discharge from the stack, a plurality of rotatable dispensing gears disposed about said opening and each having spiral grooves therein for receiving the rims of the cups to lower the cup rims with rotation of the dispensing gears, means for rotating said dispensing gears to lower a cup rim from the stack of cups, cup stripper disks located at the lower ends of the dispensing gears and having a groove therein aligned with a spiral groove of an associated dispensing gear to receive the cup rim therein, means extending between said disks and its associated dispensing gear to maintain alignment in the grooves in the disks and in the dispensing gears and for rotating the disks with its associated dispensing gear, and means for reciprocating said disks relative to said dispensing gears for forcing the cup rims downwardly relative to the dispensing gears to assure stripping of the discharging cup from the stack of nested cups and to impart a downward impetus to the discharging cup.

* * * * *

UNITED STATES PATENT AND TRADEMARK OFFICE

CERTIFICATE OF CORRECTION

PATENT NO. : 4,042,148

DATED : August 16, 1977

INVENTOR(S) : Ralph D. Gerben

It is certified that error appears in the above-identified patent and that said Letters Patent are hereby corrected as shown below:

In the patent Abstract, line 7, after "seals" change "cups" to --caps--.
Column 1, line 49, "cpping" should be --capping--.

Column 5, line 11, after "release" change "or" to --for--.
Column 6, line 41, "formcing" should be --forcing--.
Column 6, line 52, after "input" insert --gear--.
Column 7, line 35, "shiftedvertically" should be --shifted vertically--.
Column 8, line 8, after "bore" change "223" to --233--.

Column 9, line 48, after "its" change "limit other" to --other limit--.
Column 12, line 27, "FIG." should be --FIGS.--.
Column 22, line 14, "os" should be --of--.
Column 22, line 66, after "feed" change "spaced" to --speed--.
Column 23, line 38, after "the" change "slid" to --slide--.
Column 23, line 63, after "rods" change "719" to --718--.
Column 24, line 54, after "heat" (second occurrence) change "seat" to --seal--.

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*